US009090083B2

(12) United States Patent
Tsuji

(10) Patent No.: US 9,090,083 B2
(45) Date of Patent: Jul. 28, 2015

(54) FLOW PATH OPENING/CLOSING DEVICE AND INKJET RECORDING APPARATUS PROVIDED WITH THE FLOW PATH OPENING/CLOSING DEVICE

(71) Applicant: KYOCERA Document Solutions Inc., Osaka (JP)

(72) Inventor: Kikunosuke Tsuji, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/338,394

(22) Filed: Jul. 23, 2014

(65) Prior Publication Data

US 2015/0035913 A1 Feb. 5, 2015

(30) Foreign Application Priority Data

Jul. 30, 2013 (JP) ..... 2013-157296
Jul. 30, 2013 (JP) ..... 2013-157314

(51) Int. Cl.
*B41J 2/175* (2006.01)
*F04B 43/08* (2006.01)

(52) U.S. Cl.
CPC ..... *B41J 2/17596* (2013.01)

(58) Field of Classification Search
USPC ..... 347/7, 23, 30, 66, 84, 85, 86; 417/476, 417/477.3, 477.7, 477.8
See application file for complete search history.

(56) References Cited

U.S. PATENT DOCUMENTS 5,801,736 A * 9/1998 Ikkatai et al. ..... 347/86
6,082,851 A * 7/2000 Shihoh et al. ..... 347/85
6,491,365 B2 * 12/2002 Sonobe ..... 347/22
6,705,712 B2 * 3/2004 Usui et al. ..... 347/86
7,654,656 B2 * 2/2010 Umeda et al. ..... 347/85

FOREIGN PATENT DOCUMENTS

JP 08-267787 10/1996
JP 2012-030398 2/2012

* cited by examiner

*Primary Examiner* — Anh T. N. Vo
(74) *Attorney, Agent, or Firm* — Wenderoth, Lind & Ponack, L.L.P.

(57) ABSTRACT

A flow path opening/closing device includes a tube through which a recording liquid flows, a tube support member on which the tube is mounted, an opening/closing member configured to rotate between a closing position and an opening position, and an elastic support member. In the closing position, the opening/closing member crushes the tube mounted on the tube support member, thereby cutting off a flow path defined within the tube. In the opening position, the opening/closing member allows the cutoff of the flow path to be cancelled by a restoring force of the tube. The elastic support member elastically supports the tube support member so as to move the tube support member toward and away from the opening/closing member.

9 Claims, 24 Drawing Sheets

Fig.4

| Operation | Second Ink Flow Path | Third Ink Flow Path |
|---|---|---|
| Printing | Open | Open |
| Pump Filling | Open | Closed |
| Purge | Closed | Open |

Fig.14

| Rotation Angle of Rotary Cam Member from Origin | | 0 | 60 | 120 | 180 | 240 | 300 |
|---|---|---|---|---|---|---|---|
| Operation of Inkjet Head | | Printing Operation | Pump Filling Operation | Purge Operation | Filter Bubble Removing Operation | Pump Bubble Removing Operation | Whole Path Opening Operation |
| First Opening/ Closing Cam Portion | Between Filter and Sub Tank (Fourth Ink Flow Path) | Closed | Closed | Closed | Open | Closed | Open |
| Second Opening/ Closing Cam Portion | Between Pump and Inkjet Head (Third Ink Flow Path) | Open | Closed | Open | Open | Closed | Open |
| Third Opening/ Closing Cam Portion | Between Sub Tank and Pump (Second Ink Flow Path) | Open | Open | Closed | Closed | Closed | Open |
| Fourth Opening/ Closing Cam Portion | Between Piston and Sub Tank (Fifth Ink Flow Path) | Closed | Open | Closed | Closed | Open | Open |

Fig.17
| Cam Portion | Printing Operation | State |
|---|---|---|
| First Opening/ Closing Cam Portion | 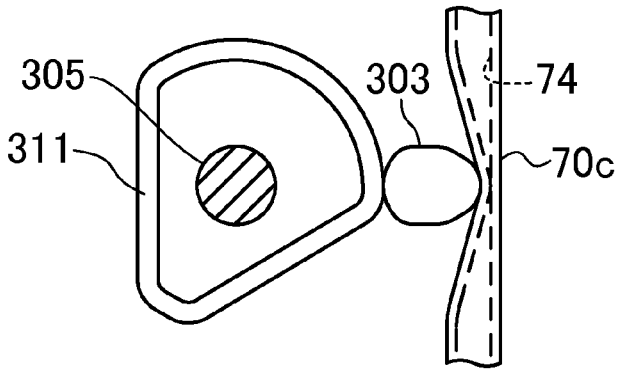 | Closed |
| Second Opening/ Closing Cam Portion | 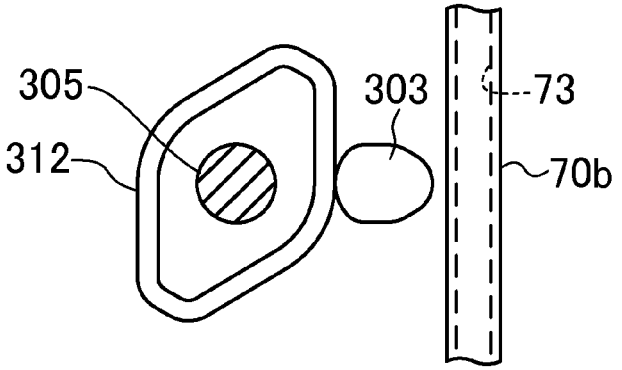 | Open |
| Third Opening/ Closing Cam Portion | 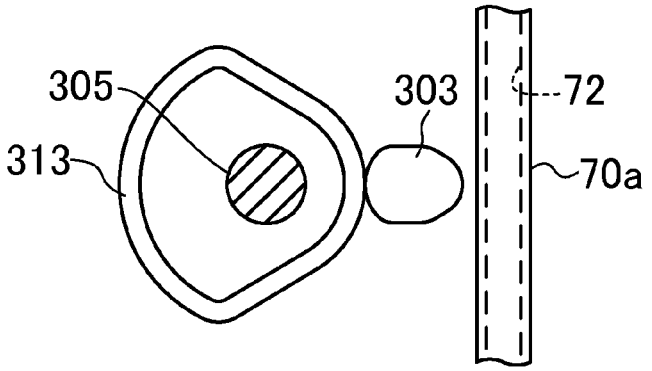 | Open |
| Fourth Opening/ Closing Cam Portion | 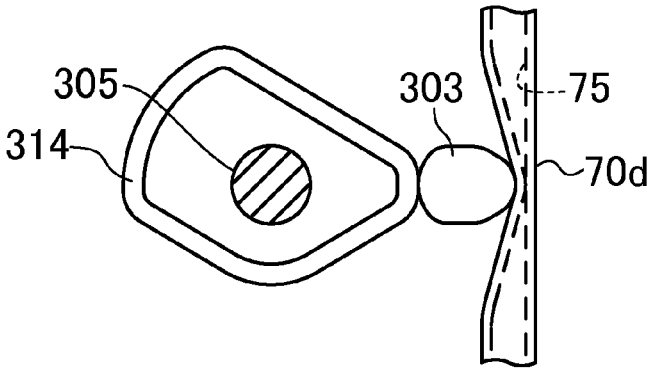 | Closed |

Fig.18
| Cam Portion | Pump Filling Operation | State |
|---|---|---|
| First Opening/ Closing Cam Portion | 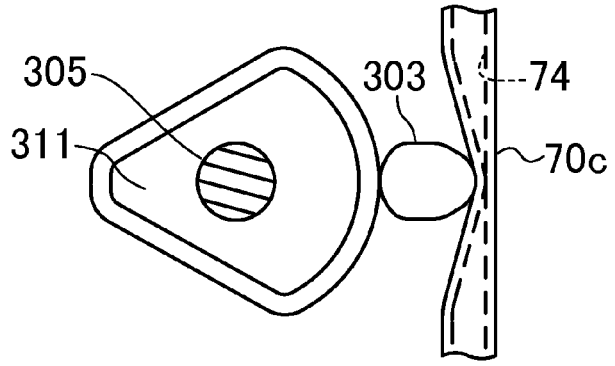 | Closed |
| Second Opening/ Closing Cam Portion | 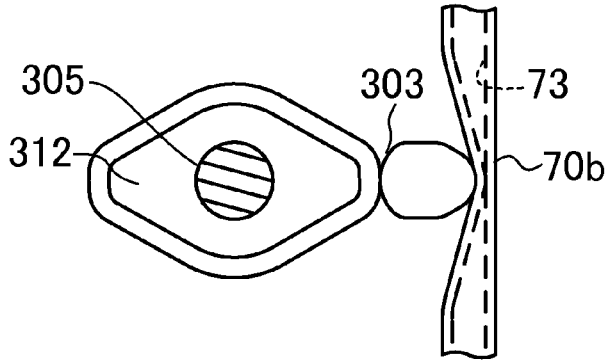 | Closed |
| Third Opening/ Closing Cam Portion | 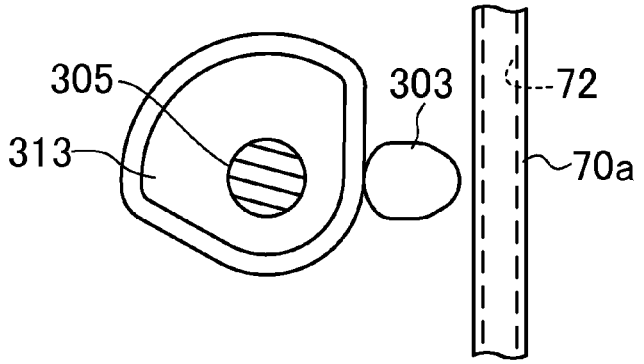 | Open |
| Fourth Opening/ Closing Cam Portion | 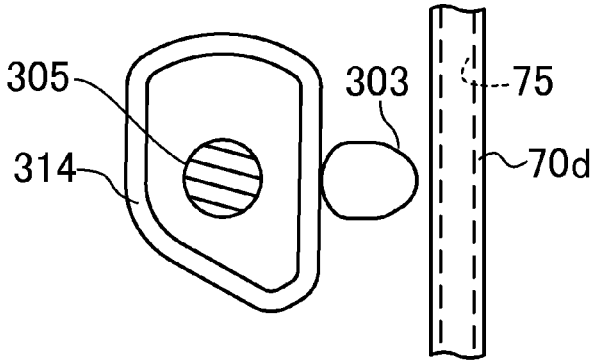 | Open |

Fig.19
| Cam Portion | Purge Operation | State |
|---|---|---|
| First Opening/ Closing Cam Portion | 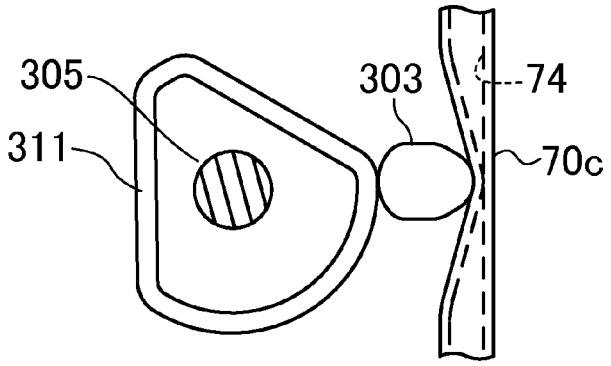 | Closed |
| Second Opening/ Closing Cam Portion | 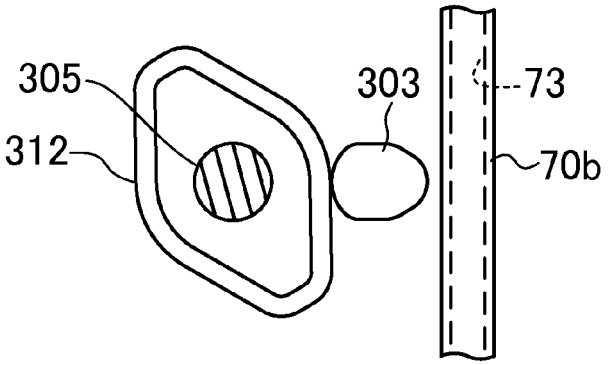 | Open |
| Third Opening/ Closing Cam Portion | 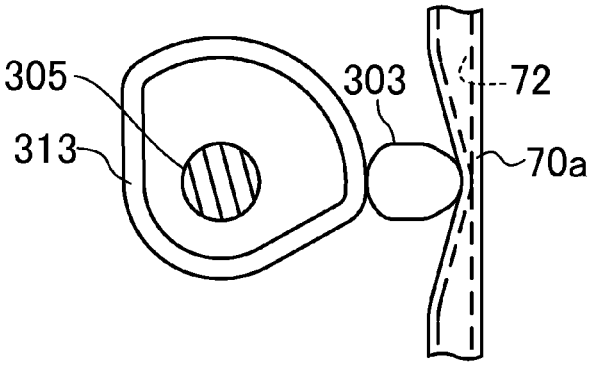 | Closed |
| Fourth Opening/ Closing Cam Portion | 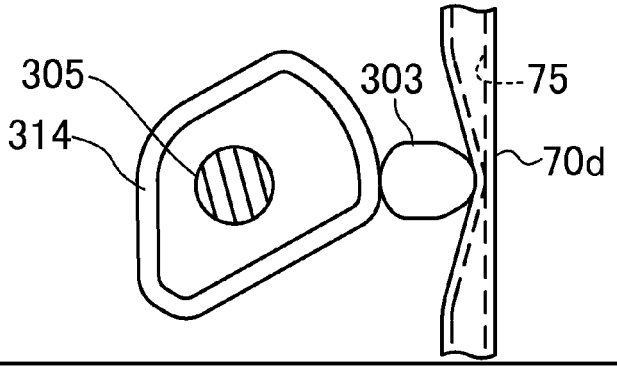 | Closed |

Fig.20
| Cam Portion | Filter Bubble Removing Operation | State |
|---|---|---|
| First Opening/ Closing Cam Portion | 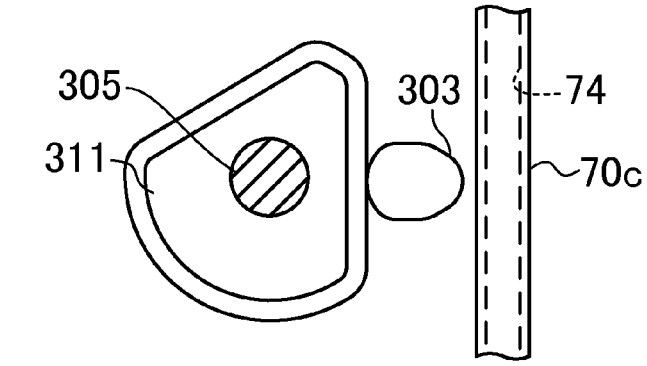 | Open |
| Second Opening/ Closing Cam Portion | 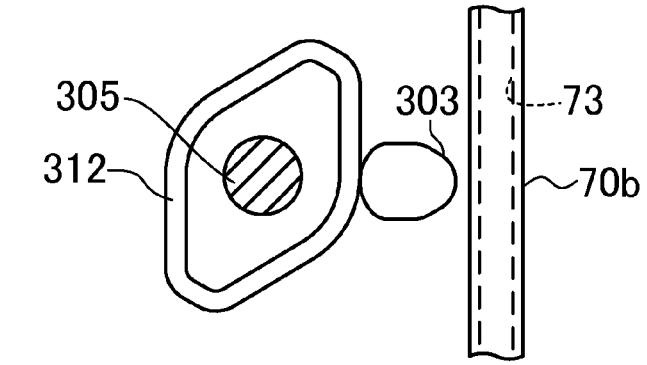 | Open |
| Third Opening/ Closing Cam Portion | 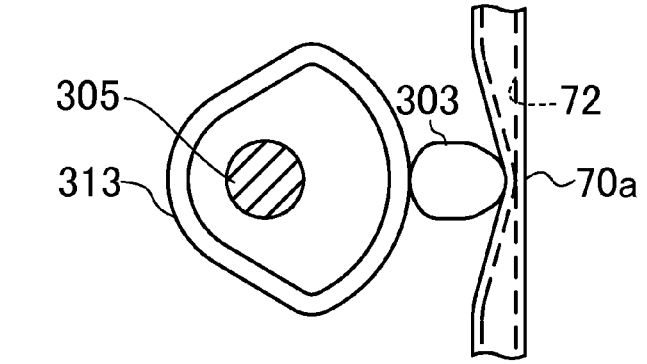 | Closed |
| Fourth Opening/ Closing Cam Portion | 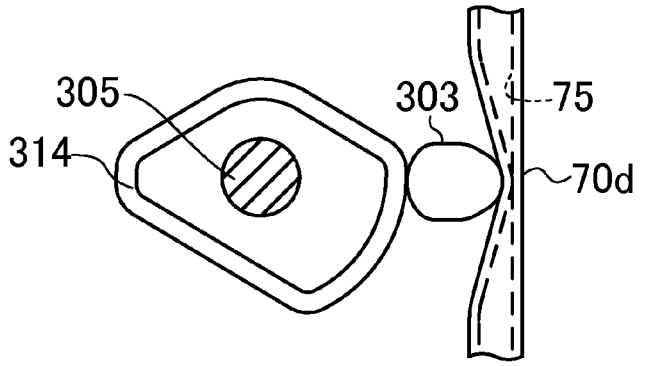 | Closed |

Fig.21
| Cam Portion | Pump Bubble Removing Operation | State |
|---|---|---|
| First Opening/ Closing Cam Portion | 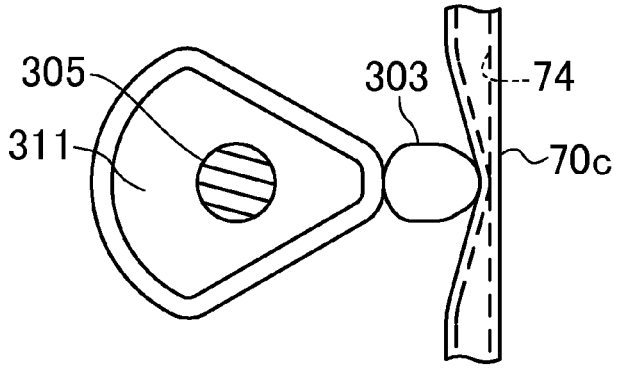 | Closed |
| Second Opening/ Closing Cam Portion | 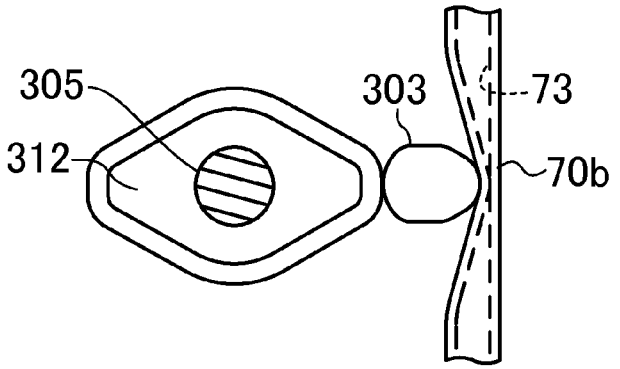 | Closed |
| Third Opening/ Closing Cam Portion | 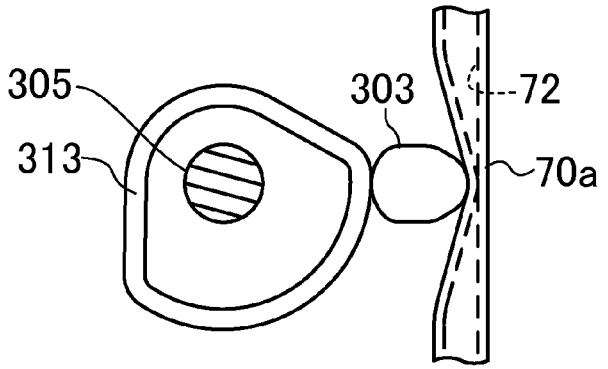 | Closed |
| Fourth Opening/ Closing Cam Portion | 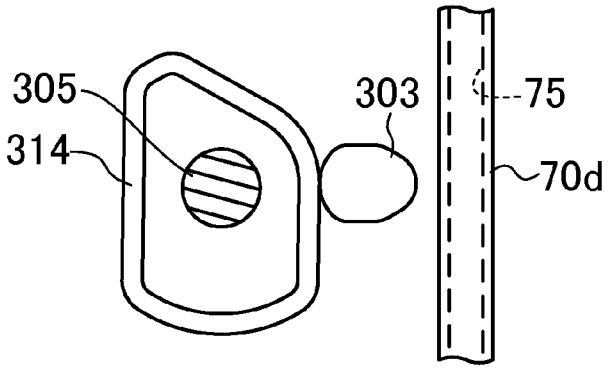 | Open |

Fig.22
| Cam Portion | Whole Path Opening Operation | State |
|---|---|---|
| First Opening/ Closing Cam Portion | 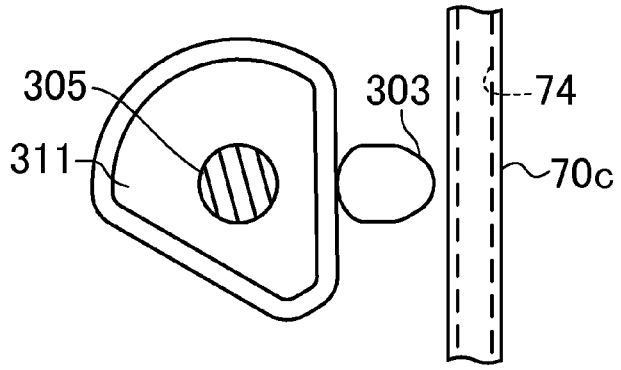 | Open |
| Second Opening/ Closing Cam Portion | 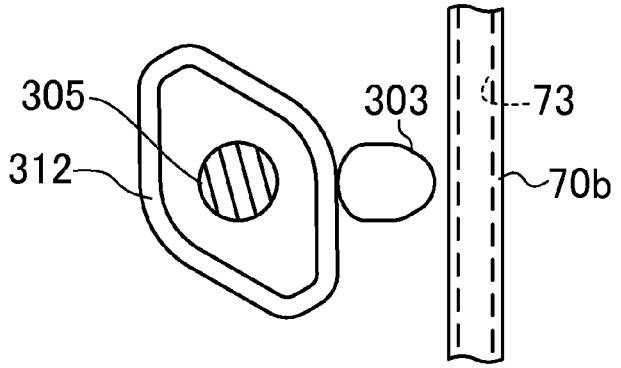 | Open |
| Third Opening/ Closing Cam Portion | 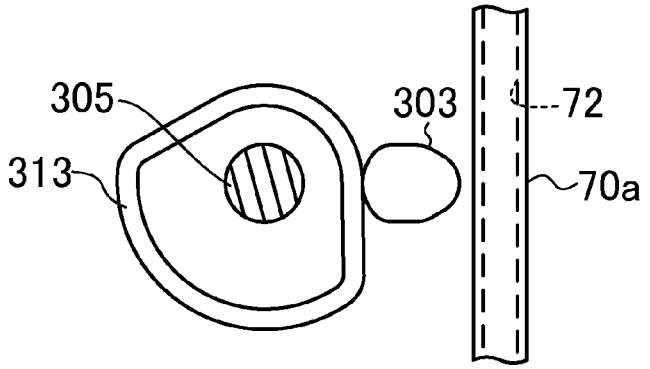 | Open |
| Fourth Opening/ Closing Cam Portion | 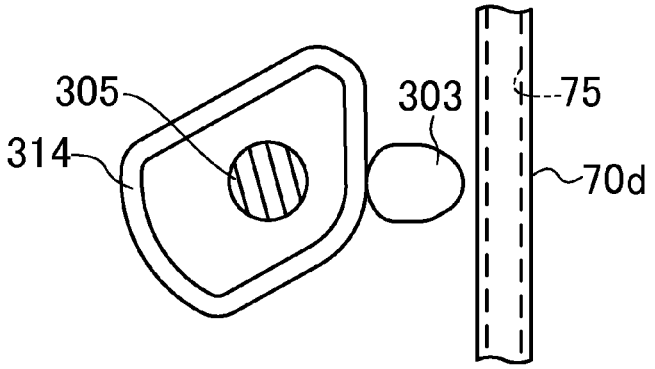 | Open |

FLOW PATH OPENING/CLOSING DEVICE AND INKJET RECORDING APPARATUS PROVIDED WITH THE FLOW PATH OPENING/CLOSING DEVICE

CROSS-REFERENCE TO RELATED APPLICATIONS

This application is based upon and claims the benefit of priority from Japanese Patent Application Nos. 2013-157296 and 2013-157314, the entire contents of which are incorporated herein by reference.

BACKGROUND

The technology of the present disclosure relates to a flow path opening/closing device and an inkjet recording apparatus provided with the flow path opening/closing device.

In the related art, as a flow path opening/closing device for a tube through which a recording liquid flows, there is known a flow path opening/closing device that includes an opening/closing member driven by a rotary cam. In this flow path opening/closing device, a pinch valve as an opening/closing member is driven by a cam member. A tube mounted on a tube support member is crushed by the pinch valve, thereby cutting off a flow path defined within the tube.

SUMMARY

A flow path opening/closing device according to one aspect of the present disclosure includes a tube through which a recording liquid flows, a tube support member on which the tube is mounted, an opening/closing member having a closing position and an opening position, and an elastic support member. In the closing position, the opening/closing member crushes the tube mounted on the tube support member, thereby cutting off a flow path defined within the tube. In the opening position, the opening/closing member allows the cutoff of the flow path to be cancelled by a restoring force of the tube. The elastic support member elastically supports the tube support member so as to move toward and away from the opening/closing member.

An inkjet recording apparatus according to another aspect of the present disclosure includes the flow path opening/closing device, an ink tank configured to retain a recording liquid, an inkjet head configured to record an image by ejecting the recording liquid on a recording paper, a pump configured to supply the recording liquid retained in the ink tank to the inkjet head, and a plurality of flow paths connected to the pump.

The plurality of flow paths includes a first flow path configured to interconnect the ink tank and the pump and a second flow path configured to interconnect the pump and the inkjet head.

The opening/closing member of the flow path opening/closing device includes a plurality of opening/closing cam portions installed in a corresponding relationship with the plurality of flow paths so as to open and close the plurality of flow paths and a connecting shaft portion configured to interconnect the opening/closing cam portions installed in a corresponding relationship with the plurality of flow paths such that the opening/closing cam portions rotate as a unit. The opening/closing cam portions have such a cam shape and an arrangement that the plurality of flow paths is not closed at the same time.

BRIEF DESCRIPTION OF THE DRAWINGS

FIG. 4 is a table summarizing the operation state of an inkjet printer and the opening/closing states of a second flow path opening/closing unit and a third flow path opening/closing unit.

FIG. 14 is a table summarizing the respective operations performed by an inkjet printer according to a fourth embodiment and the opening/closing states of individual flow paths rendered by individual opening/closing cam portions.

FIG. 17 is a schematic diagram showing the states of individual opening/closing cam portions during a printing operation.

FIG. 18 is a schematic diagram showing the states of individual opening/closing cam portions during a pump filling operation.

FIG. 19 is a schematic diagram showing the states of individual opening/closing cam portions during a purge operation.

FIG. 20 is a schematic diagram showing the states of individual opening/closing cam portions during a filter bubble removing operation.

FIG. 21 is a schematic diagram showing the states of individual opening/closing cam portions during a pump bubble removing operation.

FIG. 22 is a schematic diagram showing the states of individual opening/closing cam portions during a whole path opening operation.

DETAILED DESCRIPTION

Embodiments of the present disclosure will now be described in detail with reference to the accompanying drawings. The technology of the present disclosure is not limited to the following embodiments.

First Embodiment

Overall Configuration

Figure 1:
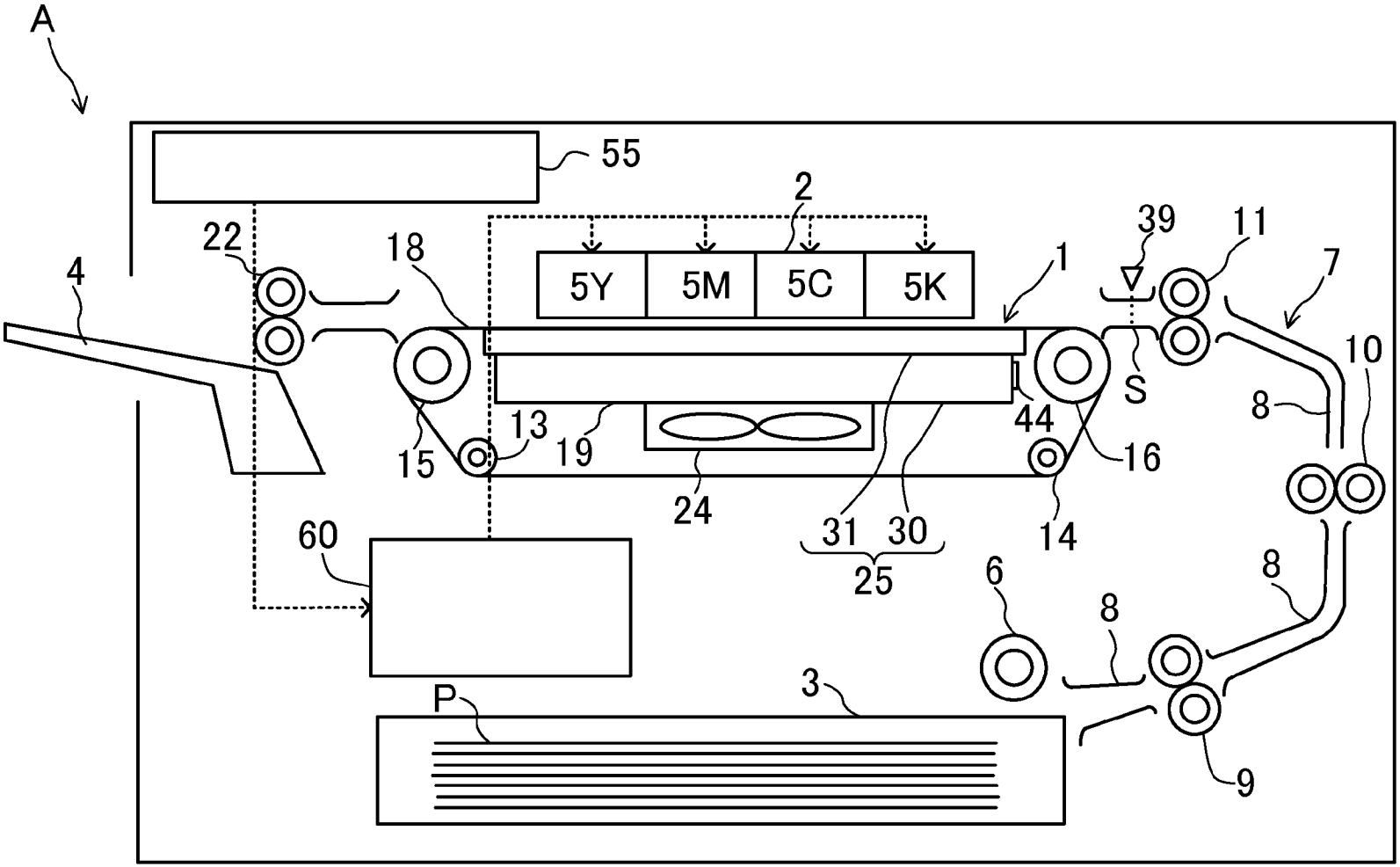
FIG. 1 is a sectional view showing an inkjet printer as an inkjet recording apparatus provided with a flow path opening/closing device according to a first embodiment.

FIG. 1 shows an inkjet printer A as an inkjet recording apparatus provided with a flow path opening/closing device 100 according to the present embodiment. The inkjet printer A includes an inkjet head 2 for performing a printing job by ejecting an ink on a paper P as a printed medium, a paper feeding cassette 3 for accommodating the paper P therein, a paper conveying device 1 arranged in an opposing relationship with the inkjet head 2, a discharge tray 4 for accommodating the printed paper P, and an ink supply mechanism 50 for supplying an ink to the inkjet head 2. In the following description, the terms "upstream side" and "downstream side" mean an upstream side and a downstream side in a paper conveyance direction.

The inkjet head 2 includes four printing units (line heads 5Y, 5M, 5C and 5K) sequentially arranged along the paper conveyance direction (the left-right direction in FIG. 1) of the paper conveying device 1. The respective line heads 5Y, 5M, 5C and 5K eject inks of different colors, yellow (Y), magenta (M), cyan (C) and black (K). On the lower surface of the inkjet head 2, a plurality of nozzles is formed with respect to each of the line heads 5Y, 5M, 5C and 5K. In each of the line heads 5Y, 5M, 5C and 5K, an ink supplied from the ink supply mechanism 50 is filled in a pressure chamber. By changing the volume of the pressure chamber with a piezoelectric element, the ink is ejected from the nozzles. Details of the ink supply mechanism 50 will de described later.

The paper feeding cassette 3 is installed in the bottom portion of the apparatus and is capable of accommodating a plurality of sheet-like papers P in a layered state.

A paper feeding roller 6 for performing paper feeding is installed in the paper feeding cassette 3. A conveyance route 7 for guiding the paper P of the paper feeding cassette 3 to the paper conveying device 1 is installed at the downstream side of the paper feeding roller 6. The conveyance route 7 is defined by guide plates 8. In the conveyance route 7, a first conveyance roller pair 9, a second conveyance roller pair 10 and a registration roller pair 11 are installed in the named order from the upstream side toward the downstream side. The paper P fed from the paper feeding cassette 3 by the paper feeding roller 6 is conveyed to the registration roller pair 11 by the first and second conveyance roller pairs 9 and 10 and is fed into the paper conveying device 1 by the registration roller pair 11 at a specified timing.

The paper conveying device 1 is arranged below the inkjet head 2 and faces the inkjet head 2. The paper conveying device 1 conveys the paper P supplied by the registration roller pair 11, from the vicinity of the upstream side of the inkjet head to the vicinity of the downstream side thereof. A paper discharge roller pair 22 and a paper discharge tray 4 are installed at the downstream side of the paper conveying device 1.

The paper conveying device 1 includes a driving roller 15, a driven roller 16, two tension rollers 13 and 14, a ring-shaped conveyance belt 18 wound around the four rollers 13 to 16, and a negative pressure generating device 19 installed radially inward of the conveyance belt 18.

The driving roller 15 is a roller for transmitting a drive force to the conveyance belt 18 and is arranged on the downstream side of the inkjet head 2. The driving roller 15 is operatively connected to a driving motor (not shown).

The driven roller 16 is arranged on the upstream side of the inkjet head 2. The driven roller 16 is disposed substantially at the same height as the driving roller 15. The tension rollers 13 and 14 are rollers for adjusting the tension of the conveyance belt 18 and are arranged below the driving roller 15 and the driven roller 16.

The upper surface of the conveyance belt 18 constitutes a paper conveyance surface for conveying the paper P. The conveyance belt 18 conveys the paper P while sucking and holding the paper P on the upper surface thereof. While not shown in the drawings, a multiplicity of air holes extending in a belt thickness direction is formed in the conveyance belt 18. The respective air holes serve to apply a negative pressure generated by the negative pressure generating device 19 to the paper P.

The negative pressure generating device 19 includes a fan case 25 to which a fan 24 is attached. The fan case 25 is composed of a case body 30 opened upward and a thick top plate portion 31 that covers the upper side of the case body 30. The fan 24 is attached to the lower surface of the case body 30. When operated, the fan 24 generates a negative pressure within the fan case 25. The top plate portion 31 makes contact with the inner circumferential surface of the conveyance belt 18. Through the conveyance belt 18 and at the lower side of the conveyance belt 18, the top plate portion 31 guides and supports the paper P held on the upper surface (the outer circumferential surface) of the conveyance belt 18.

—Ink Supply Mechanism—

Figure 2:
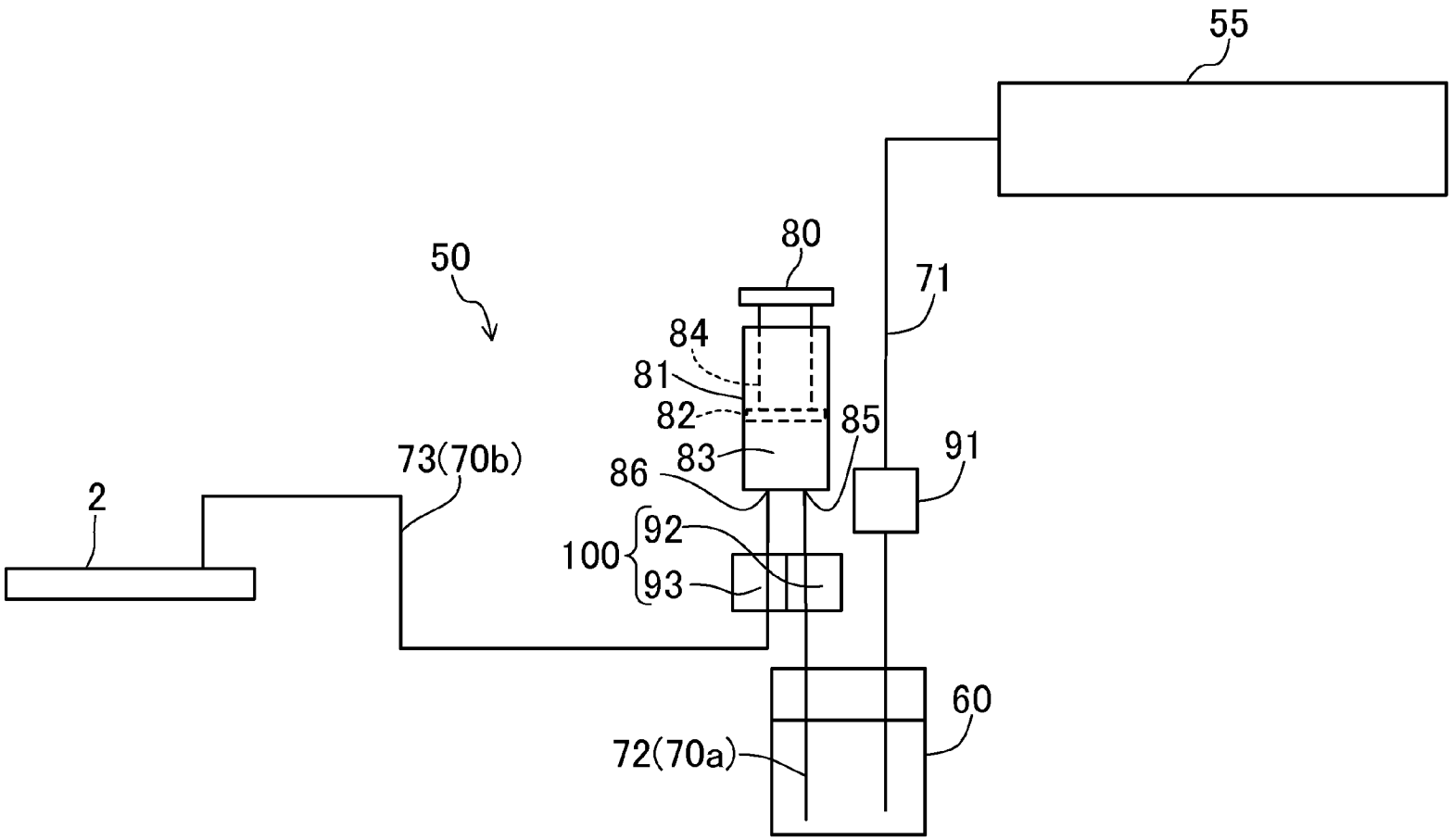
FIG. 2 is a flow path system diagram showing a configuration of an ink supply mechanism.

The configuration of the ink supply mechanism 50 according to the present embodiment will now be described with reference to FIG. 2. Four ink supply mechanisms 50 are installed in a corresponding relationship with four printing units (line heads 5Y, 5M, 5C and 5K). As shown in FIG. 2, each of the ink supply mechanism 50 includes a main tank 55, a sub tank 60, first to third ink flow paths 71 to 73, and a pump 80.

The main tank 55 is a sealed tank that stores an ink as a recording liquid and is mounted to the upper portion of the inkjet printer A. The sub tank 60 is arranged below the main tank 55. The sub tank 60 stores the ink supplied from the main tank 55 and supplies the stored ink to a specified one of the line heads 5Y, 5M, 5C and 5K (hereinafter just referred to as "line head").

The pump 80 is a so-called syringe type pump. The pump 80 includes a cylinder 81 extending in an up-down direction, a piston 82 accommodated within the cylinder 81 to make a reciprocating motion, and an ink accommodating chamber 83 defined by the piston 82 and the cylinder 81. An ink inlet 85 and an ink outlet 86 are formed in the lower end portion of the cylinder 81. The ink inlet 85 is connected to the sub tank 60 through the second ink flow path (corresponding to a first flow path) 72. The ink outlet 86 is connected to the inkjet head 2 through the third ink flow path (corresponding to a second flow path) 73.

Figure 3:
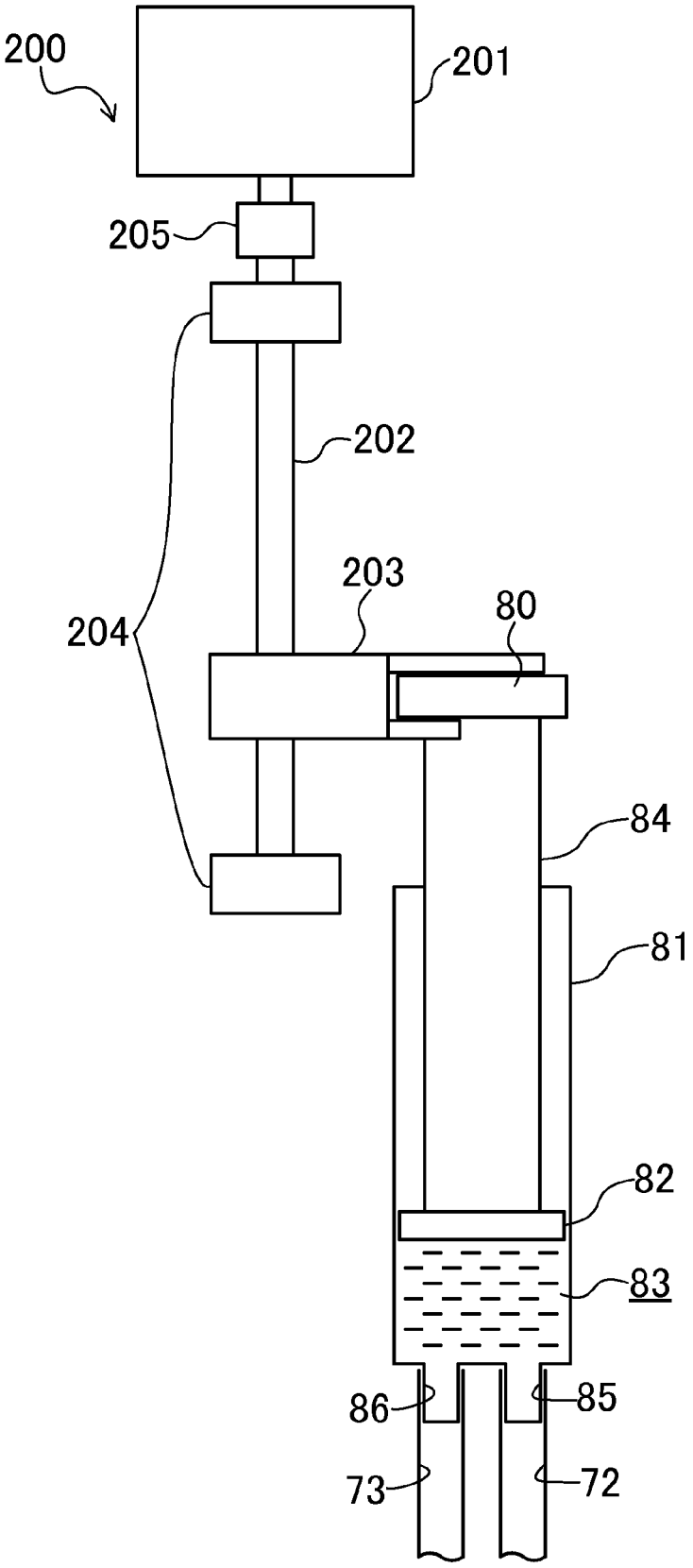
FIG. 3 is a schematic diagram showing a pump drive mechanism which is a part of the ink supply mechanism.

As shown in FIG. 3, the piston 82 is connected to a piston drive unit 200 through a piston rod 84. The piston drive unit 200 includes a motor 201, a shaft member 202 having a male thread portion formed on the outer circumferential surface thereof, and a ball nut member 203 threadedly engaging with the male thread portion of the shaft member 202 through a plurality of balls. The shaft member 202 is formed to extend in the up-down direction. The opposite end portions of the shaft member 202 are rotatably supported by a pair of bearings 204. The upper end portion of the shaft member 202 is operatively connected to the motor 201 through a coupling 205. The ball nut member 203 is fixed to the upper end portion of the piston rod 84 by means of bolts. In the piston drive unit 200, the shaft member 202 is rotated by the motor 201, thereby causing the piston 82 and the ball nut member 203 to reciprocate in the up-down direction. Consequently, the inside of the ink accommodating chamber 83 is pressurized or depressurized by the piston 82.

The first to third ink flow paths 71 to 73 are composed of hollow cylindrical flexible tubes. The tubes are made of, e.g., a resin material. The first ink flow path 71 is connected at one end to the main tank 55 and at the other end to the sub tank 60. An electromagnetically-driven flow path opening/closing valve 91 is installed in the intermediate portion of the first ink flow path 71. If the ink head within the sub tank 60 is lower than a predetermined height, the opening/closing valve 91 is opened by a controller not shown, thereby allowing the ink to flow from the main tank 55 into the sub tank 60. Thus, the ink head within the sub tank 60 is kept constant.

As set forth above, the second ink flow path 72 is connected at one end to the sub tank 60 and at the other end to the ink inlet 85 of the pump 80. As mentioned above, the third ink flow path 73 is connected at one end to the ink outlet 86 of the pump 80 and at the other end to the inkjet head 2. The second ink flow path 72 is composed of a tube 70*a* and the third ink flow path 73 is composed of a tube 70*b*. In the present embodiment, the tubes 70*a* and 70*b* are identical in shape and material with each other. A flow path opening/closing device 100 is installed in the intermediate portions of the second ink flow path 72 and the third ink flow path 73. The flow path opening/closing device 100 is configured to open and close the second ink flow path 72 and the third ink flow path 73.

FIG. 4 is a table showing the opening/closing states of the second ink flow path 72 and the third ink flow path 73 during a printing operation, a pump filling operation and a purge operation. As shown in the table, during the printing operation, the second and third ink flow paths 72 and 73 are opened by the flow path opening/closing device 100. During the printing operation, the same amount of ink as the ink ejected by the inkjet head 2 is supplied from the sub tank 60 to the inkjet head 2 via the second ink flow path 72, the pump 80 and the third ink flow path 73 by virtue of a capillary tube phenomenon. In the following description, the terms "open state" and "closed state" mean a fully open state and a fully closed state unless specifically mentioned otherwise.

During the pump filling operation, the second ink flow path 72 is opened and the third ink flow path 73 is closed by the flow path opening/closing device 100. Furthermore, during the pump filling operation, the piston 82 is driven upward by the piston drive unit 200, whereby the ink is supplied from the sub tank 60 to the ink accommodating chamber 83 of the pump 80 through the second ink flow path 72. During the purge operation, the second ink flow path 72 is closed and the third ink flow path 73 is opened by the flow path opening/closing device 100. During the purge operation, the piston 82 is driven downward by the piston drive unit 200, whereby the ink existing within the pump 80 is supplied to the inkjet head 2 through the third ink flow path 73 and is squeezed out from the nozzles of the inkjet head 2. This makes it possible to relieve the clogging of the nozzles which may be caused by an increase in the viscosity of the ink.

—Flow Path Opening/Closing Device—

The flow path opening/closing device 100 includes a second ink flow path opening/closing unit 92 for opening and closing the second ink flow path 72 and a third ink flow path opening/closing unit 93 for opening and closing the third ink flow path 73 (see FIG. 2). The opening/closing units 92 and 93 are identical in configuration with each other. Therefore, in the following description, only the configuration of the second ink flow path opening/closing unit 92 will be described with the detailed description on the third ink flow path opening/closing unit 93 omitted.

Figure 5:
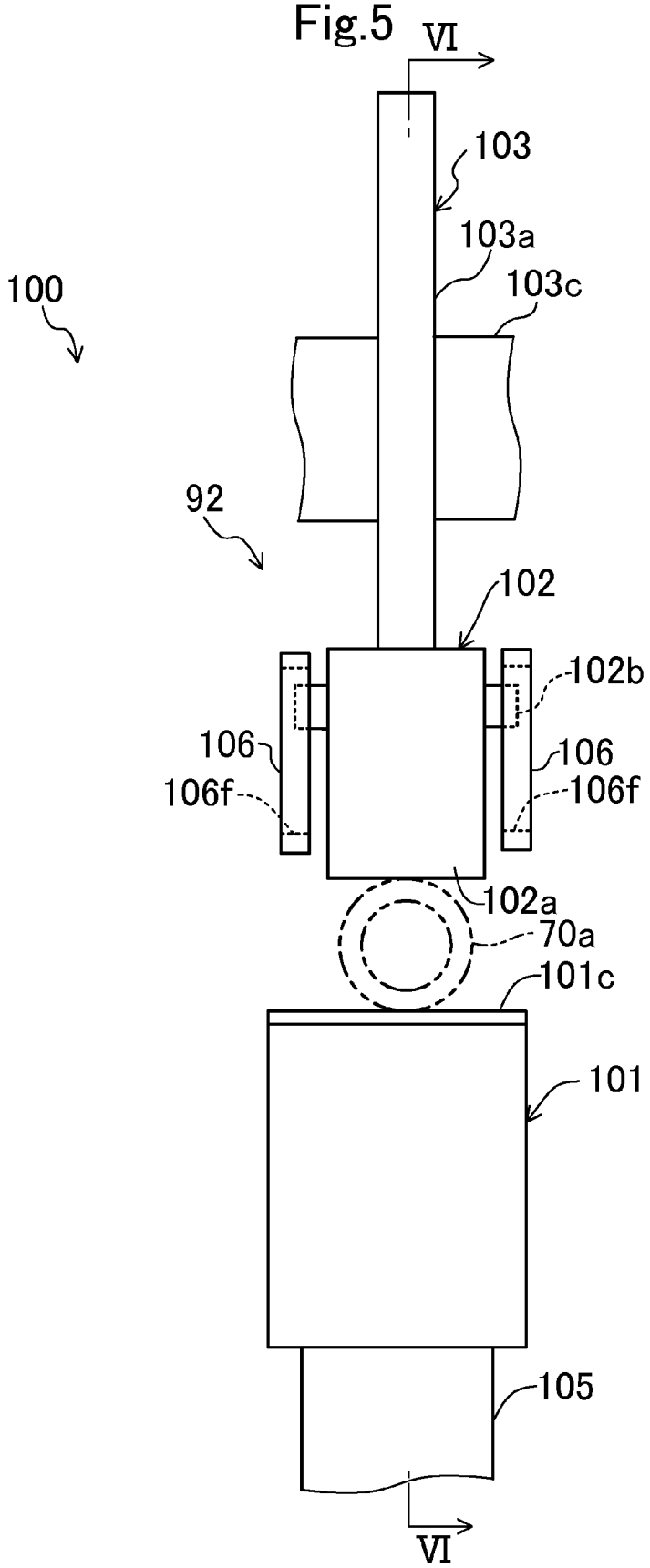
FIG. 5 is a side view showing a flow path opening/closing device.
Figure 6:
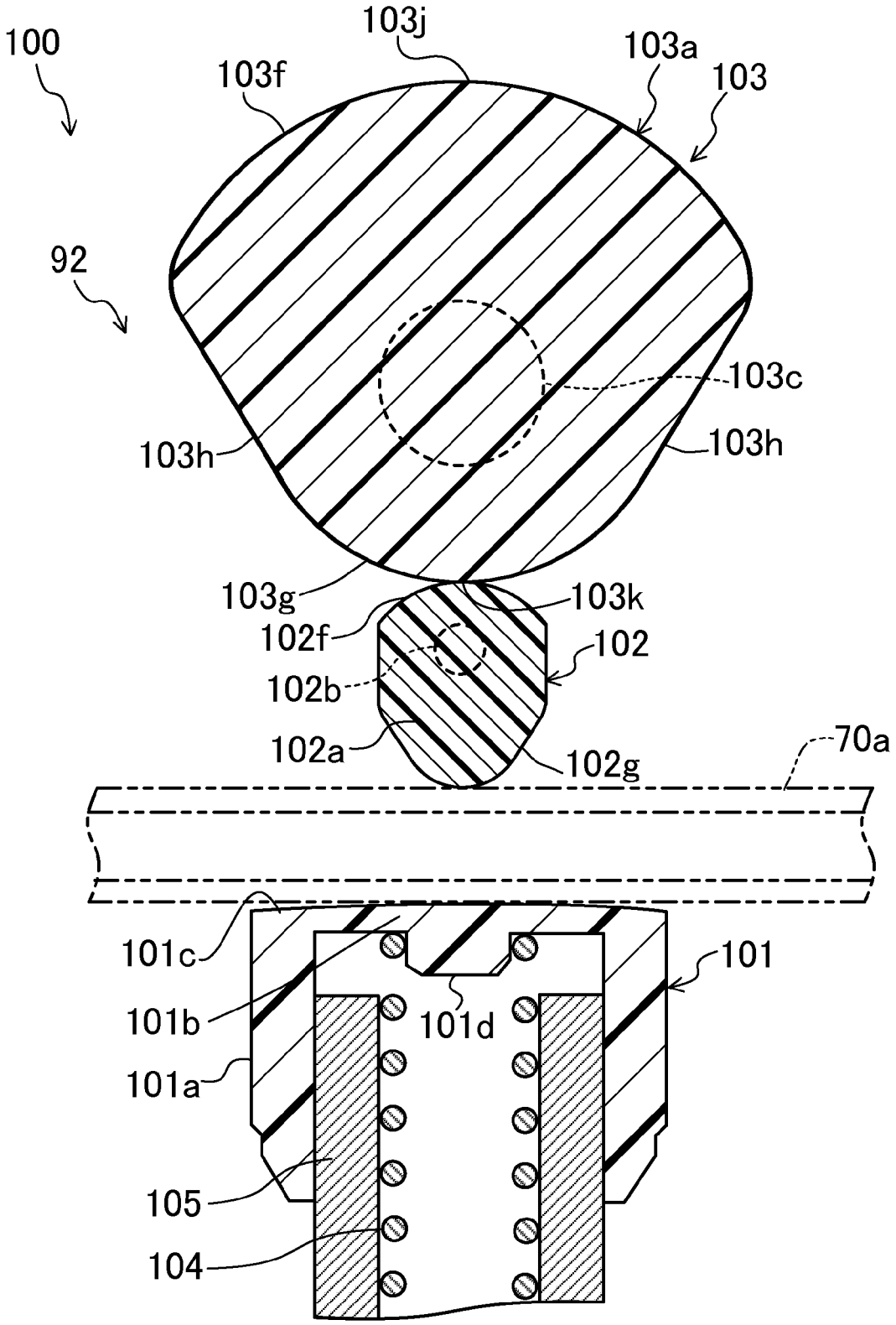
FIG. 6 is a sectional view taken along line VI-VI in FIG. 5, showing a state in which an opening/closing member is in an opening position.
Figure 7:
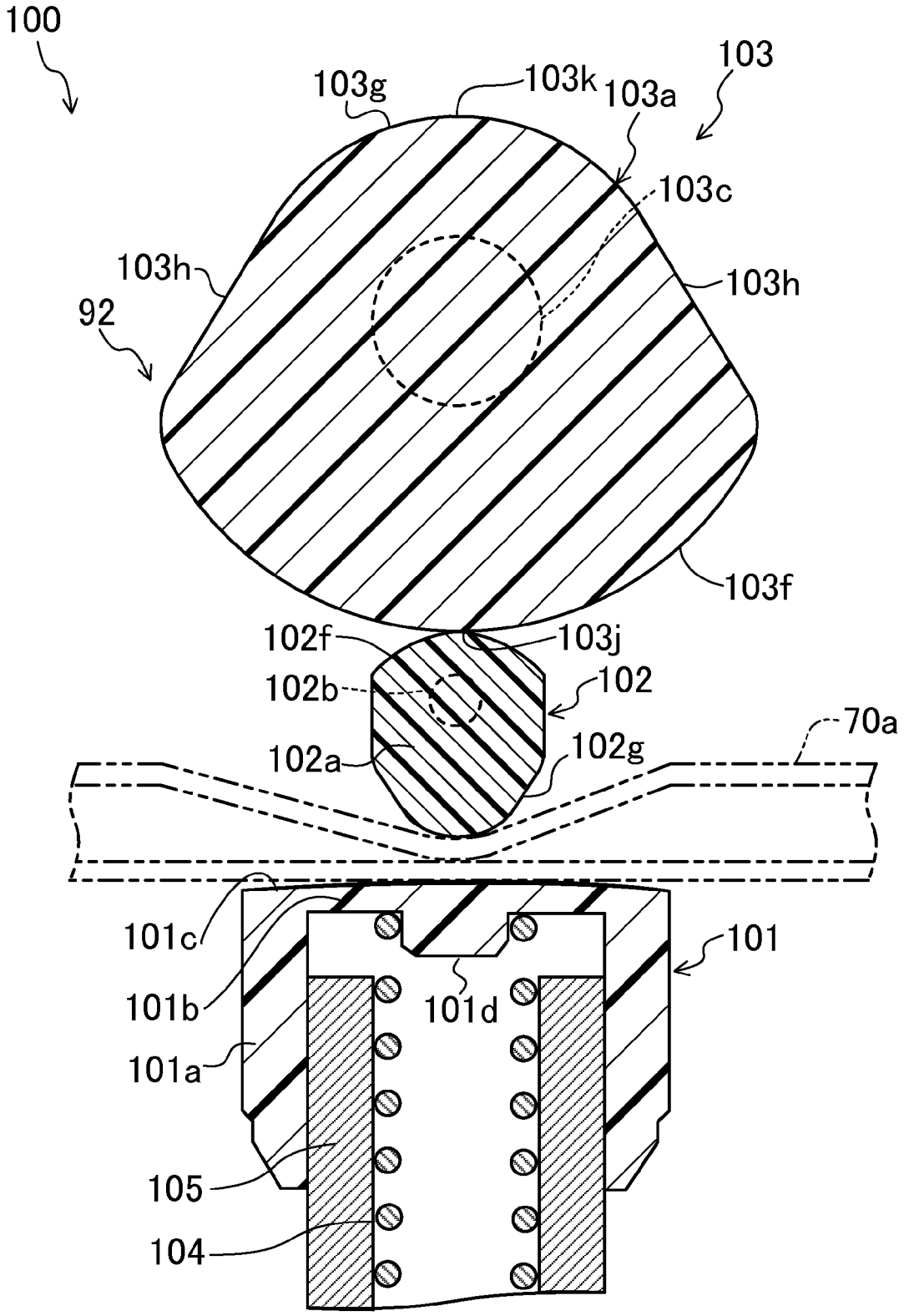
FIG. 7 is a view corresponding to the sectional view taken along line VI-VI in FIG. 5, showing a state in which the opening/closing member is in a closing position.

As shown in FIGS. 5 to 7, the second ink flow path opening/closing unit 92 of the flow path opening/closing device 100 includes a tube support member 101 on which the tube 70*a* is mounted, an opening/closing member 102 for opening and closing the flow path defined within the tube 70*a*, a rotary cam member 103 for driving the opening/closing member 102, and a biasing spring 104 as an elastic support member for elastically supporting the tube support member 101 at the lower side thereof.

The tube support member 101 is formed into a downwardly-opened cylindrical shape with a closed top. That is to say, the tube support member 101 is composed of a cylindrical portion 101*a* extending in the up-down direction and a top wall portion 101*b* for covering the upper side of the cylindrical portion 101*a*. The upper end surface of the tube support member 101 has, e.g., a circular shape when seen in a plane view and serves as a mounting surface 101*c* on which the tube 70*a* is mounted. The tube 70*a* is mounted on the mounting surface 101*c* in an orthogonal relationship with the axis direction of the rotary cam member 103. The mounting surface 101*c* is formed into an arc surface shape such that the central portion thereof in the radial direction (the left-right direction in FIG. 7) bulges more upward than the opposite end portions thereof when seen in the axis direction of the rotary cam member 103. The curvature radius of the arc surface is sufficiently larger than the curvature radius of the external surface of the tube 70*a*.

The tube support member 101 is externally fitted to a cylindrical guide pipe 105 fixed to a housing of the inkjet printer A. The tube support member 101 can slide in the up-down direction along the guide pipe 105. A clearance is defined between the top end of the guide pipe 105 and the top wall portion 101*b* of the tube support member 101 such that the top end of the guide pipe 105 and the top wall portion 101*b* of the tube support member 101 do not make contact with each other even if the biasing spring 104 is expanded and contracted in response to the opening and closing of the tube 70*a*.

The biasing spring 104 is composed of a compression coil spring internally fitted into guide pipe 105. The biasing spring 104 biases the tube support member 101 upward at all times. The top end of the biasing spring 104 makes contact with the top wall portion 101*b* of the tube support member 101, thereby elastically supporting the tube support member 101 at the lower side thereof. The tube support member 101 is elastically supported by the biasing spring 104 so as to move in the up-down direction. In other words, the tube support member 101 is elastically supported so as to move toward and away from the opening/closing member 102. A cylindrical boss portion 101*d* protruding downward is formed in the top wall portion 101*b* of the tube support member 101. The top end portion of the biasing spring 104 is externally fitted to the boss portion 101*d*. Thus, the radial position of the biasing spring 104 is decided.

The rotary cam member 103 includes a plate-like cam body portion 103*a* and protrusion shaft portions 103*c* protruding from the thickness-direction opposite sides of the cam body portion 103*a*. The protrusion shaft portions 103*c* are rotatably supported by bearings not shown and are operatively connected to a motor not shown.

The cam body portion 103*a* includes a first arc surface section 103*f* bulging radially outward when seen in the direction of a rotation axis of the cam body portion 103*a*, a second arc surface section 103*g* positioned at the 180° opposite side from the first arc surface section 103*f* across the rotation axis, and flat surface sections 103*h* that interconnect the first arc surface section 103*f* and the second arc surface section 103*g*. The apex of the first arc surface section 103*f* constitutes a maximum radius section 103*j* where the distance from the rotation axis becomes greatest. The apex of the second arc surface section 103*g* constitutes a minimum radius section 103*k* where the distance from the rotation axis becomes smallest. The minimum radius section 103*k* is disposed at the 180° opposite side from the maximum radius section 103*j* across the rotation axis of the cam body portion 103*a*.

The opening/closing member 102 is linearly driven by the rotary cam member 103 so as to move toward and away from the tube support member 101. That is to say, in the present embodiment, opening/closing member 102 is linearly driven by the rotary cam member 103 so as to reciprocate in the up-down direction. The opening/closing member 102 has a closing position in which the opening/closing member 102 crushes the tube 70*a* mounted on the tube support member 101 to thereby cut off a flow path defined within the tube 70*a* and an opening position in which the cutoff of the flow path is cancelled by the restoring force of the tube 70*a*.

More specifically, the opening/closing member 102 includes a plate-like opening/closing body portion 102*a* and guide shaft portions 102*b* protruding from the thickness-direction opposite sides of the opening/closing body portion 102*a*. The axis direction of the respective guide shaft portions 102*b* coincides with the axis direction of the rotary cam member 103. The respective guide shaft portions 102*b* are supported by a pair of guide plates 106 so as to slide in the up-down direction. The guide plates 106 are installed at the opposite lateral sides of the opening/closing body portion 102*a* interposed therebetween and are fixed to the housing of the inkjet printer A. Guide holes 106*f* passing in the thickness direction of the guide plats 106 and extending in the up-down direction are formed in the respective guide plates 106. The guide shaft portions 102*b* are inserted into the guide holes 106*f*. The end portions of the guide shaft portions 102*b* are connected to tension springs not shown. The opening/closing member 102 is biased upward by the tension springs.

The opening/closing body portion 102*a* extends in the up-down direction and has a plate-like shape. The top end surface 102*f* of the opening/closing body portion 102*a* is composed of a smooth arc surface bulging upward when seen in the axis direction of the guide shaft portions 102*b*. The top end surface 102*f* serves as a cam surface pressed by the rotary cam member 103. The bottom end surface 102*g* of the opening/closing body portion 102*a* is composed of an arc surface bulging downward when seen in the axis direction of the guide shaft portions 102*b*. The bottom end surface 102*g* serves as a tube contact surface that makes contact with the external surface of the tube 70*a*. The curvature radius of the bottom end surface 102*g* of the opening/closing body portion 102*a* is smaller than that of the external surface of the tube 70*a*.

FIG. 6 shows a state in which the opening/closing member 102 is in the opening position. In this state, the minimum radius section 103*k* is positioned in the bottom end portion of the rotary cam member 103. The minimum radius section 103*k* makes contact with the top end surface 102*f* of the opening/closing member 102. At this time, the opening/closing member 102 lies in a position spaced farthest from the tube support member 101. The tube support member 101 is biased upward by the biasing spring 104. However, the upward movement of the tube support member 101 is restricted because the tube support member 101 makes contact with the opening/closing member 102 through the tube 70*a*.

If the rotary cam member 103 is rotated, e.g., clockwise, from the state shown in FIG. 6, the opening/closing member 102 is pushed downward by the rotary cam member 103. As shown in FIG. 7, when the maximum radius section 103*j* of the rotary cam member 103 makes contact with the top end surface 102*f* of the opening/closing member 102, the opening/closing member 102 comes closest to the tube support member 101. The position of the opening/closing member 102 available at this time is the closing position of the opening/closing member 102. If the opening/closing member 102 is driven to the closing position, the tube 70*a* is pinched and crushed between the bottom end surface 102*g* of the opening/closing member 102 and the mounting surface 101*c* of the tube support member 101. As a result, the flow path defined within the tube 70*a* is cut off. If the opening/closing member 102 is moved from the closing position to the opening position, the tube 70*a* is returned to the original state by the restoring force. Thus, the cutoff of the flow path is cancelled.

In the conventional flow path opening/closing device that does not include the biasing spring 104, the spaced-apart distance between the bottom end surface 102*g* of the opening/closing member 102 and the mounting surface 101*c* of the tube support member 101 varies depending on the dimensional tolerance or the assembling tolerance of the respective components such as the rotary cam member 103 and the opening/closing member 102. For that reason, if the spaced-apart distance is larger than a designed value, the pressing amount of the tube 70*a* pressed by the opening/closing member 102 becomes insufficient. This makes it impossible to completely cut off the ink flow path. Thus, ink leakage occurs. On the other hand, if the spaced-apart distance is smaller than the designed value, an excessive pressing force is applied to the tube 70*a* by the opening/closing member 102. Thus, the lifespan of the tube 70*a* decreases. The drive force required in driving the rotary cam member 103 increases.

In contrast, according to the first embodiment described above, the tube support member 101 is elastically supported by the biasing spring 104 so as to move toward and away from the opening/closing member 102. Thus, the dimensional tolerance or the assembling tolerance of the respective components can be absorbed by the expansion and contraction of the biasing spring 104. It is therefore possible to keep constant the spaced-apart distance between the opening/closing member 102 and the tube support member 101 when the opening/closing member 102 lies in the closing position. Accordingly, the opening/closing member 102 can crush the tube 70*a* with a constant pressing force at all times. Moreover, it is possible to avoid such problems as the ink leakage, the wear of the tube 70*a* and the increase in the drive force of the rotary cam member 103 mentioned above.

According to the aforementioned configuration, for example, if the internal pressure of the cylinder 81 (the internal pressure of the tube 70*a*) becomes higher than a predetermined value for whatever reasons in a state in which the ink flow path defined within the tube 70*a* is cut off by the opening/closing member 102, the tube support member 101 is pushed downward against the biasing force of the biasing spring 104 by the internal pressure of the tube 70*a*. Consequently, the damage of the pump 80 can be prevented by cancelling the cutoff of the ink flow path performed by the opening/closing member 102.

Furthermore, according to the first embodiment described above, the mounting surface 101*c* of the tube support member 101, on which the tube 70*a* is mounted, is formed into a curved surface shape such that the radial central portion of the mounting surface 101*c* bulges more upward than the opposite end portions thereof when seen in the axis direction of the rotary cam member 103. Accordingly, the tube 70*a* is mounted in such a state that the tube 70*a* makes substantially a point-to-point contact with the mounting surface 101*c*. Thus, when the tube 70*a* is crushed by the opening/closing member 102, the contact pressure applied to the tube 70*a* by the mounting surface 101*c* can be made far greater than the contact pressure available when the mounting surface 101*c* is a flat surface. It is therefore possible to reduce the drive force of the rotary cam member 103 required in crushing the tube 70*a* with the opening/closing member 102.

Second Embodiment

Figure 8:
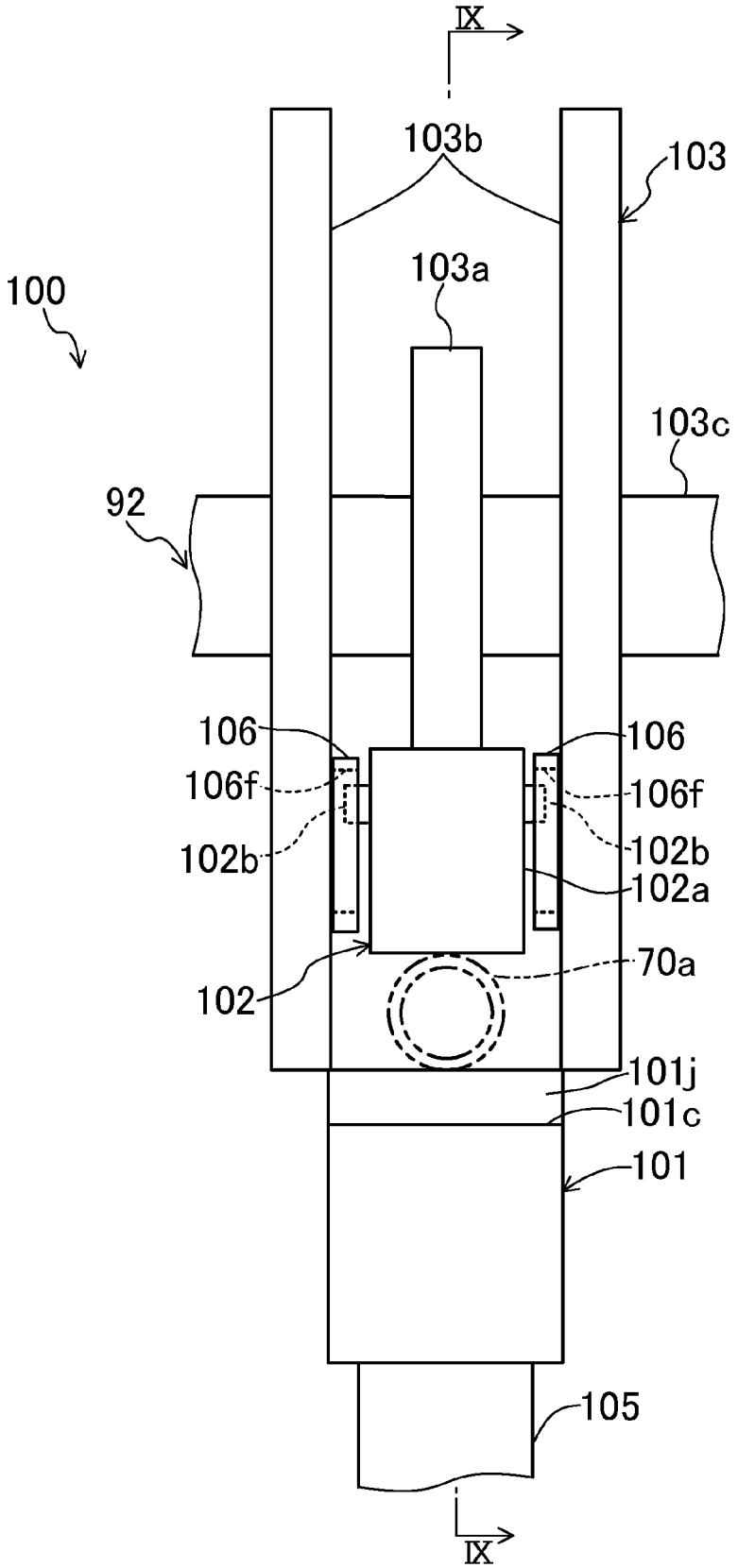
FIG. 8 is a side view of a flow path opening/closing device according to a second embodiment.
Figure 9:
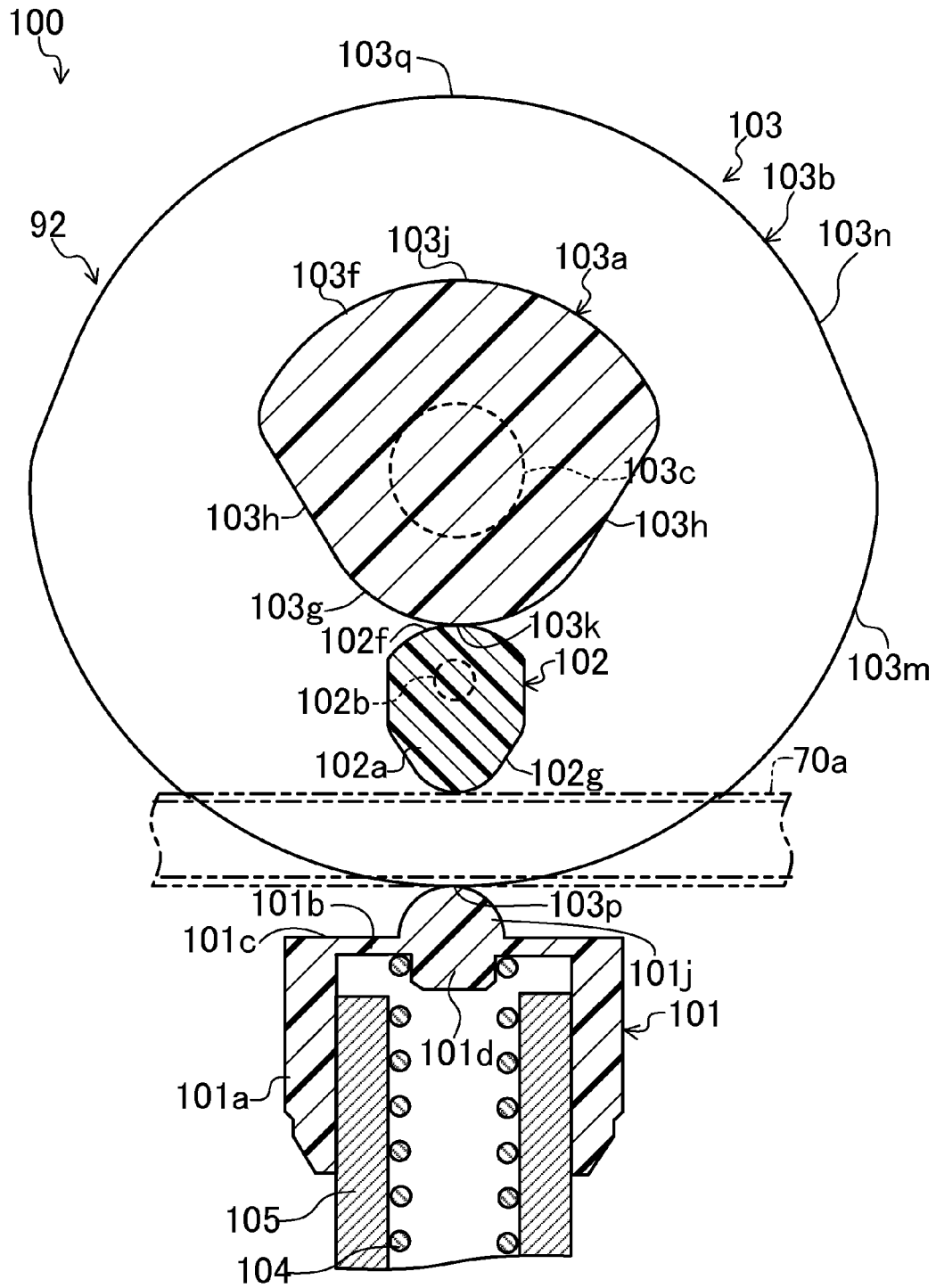
FIG. 9 is a sectional view taken along line IX-IX in FIG. 8, showing a state in which an opening/closing member is in an opening position.
Figure 10:
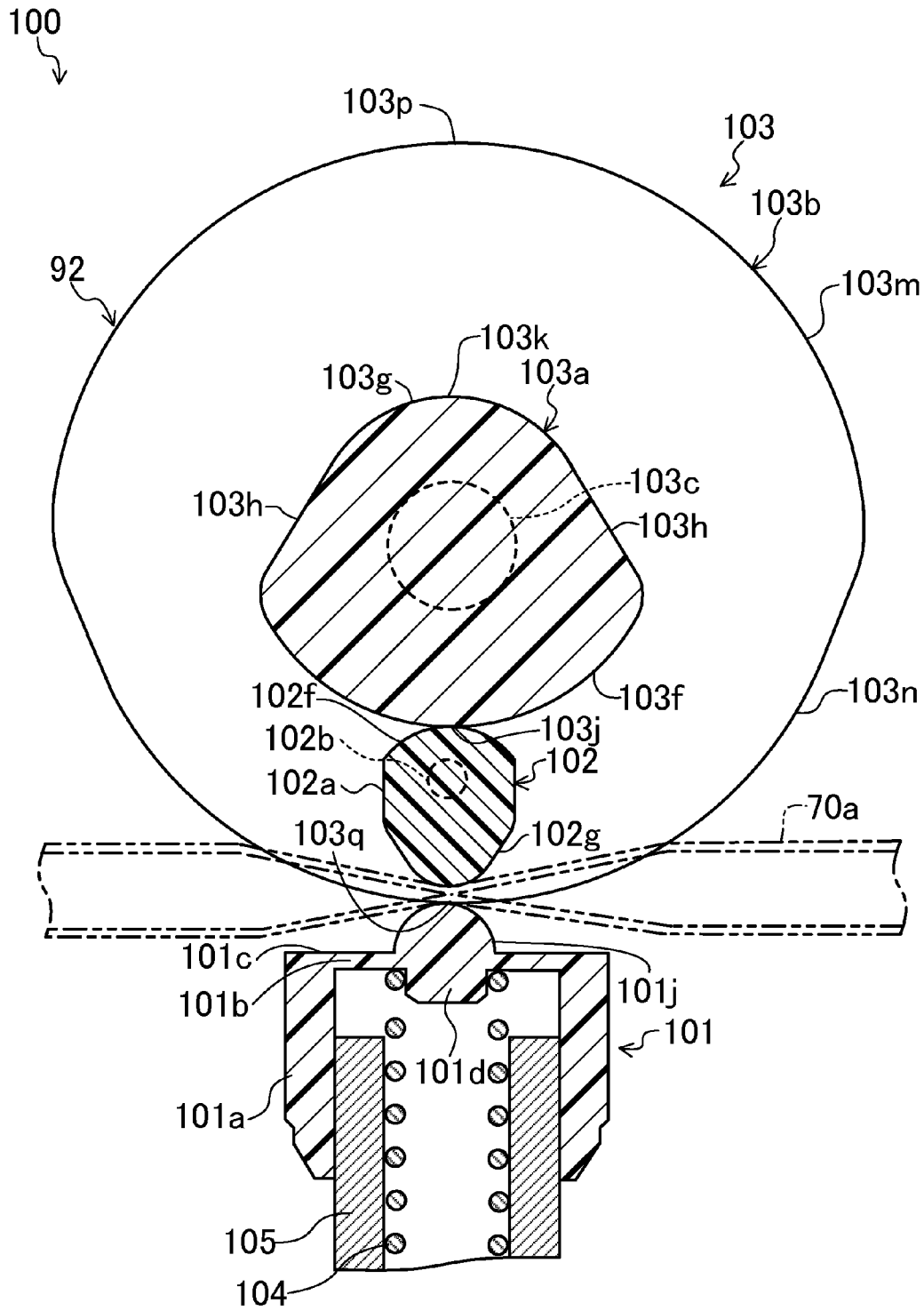
FIG. 10 is a view corresponding to the sectional view taken along line IX-IX in FIG. 8, showing a state in which the opening/closing member is in a closing position.

FIGS. 8 to 10 show a second ink flow path opening/closing unit 92 of a flow path opening/closing device 100 according to a second embodiment. The second embodiment differs from the first embodiment in terms of the configuration of the rotary cam member 103 and the configuration of the tube support member 101. The same components as those shown in FIGS. 5 to 7 will be designated by like reference symbols with detailed description thereof omitted.

That is to say, the flow path opening/closing device 100 according to the second embodiment includes a first cam body portion 103*a* having the same configuration as the cam body portion 103*a* of the first embodiment, protrusion shaft portions 103*c*, and a pair of second cam body portions 103*b*. The first cam body portion 103*a* corresponds to a first rotary cam portion. The second cam body portions 103*b* correspond to a second rotary cam portion.

The second cam body portions 103*b* are installed at the thickness-direction opposite lateral sides of the first cam body portion 103*a*. The protrusion shaft portions 103*c* pass through the second cam body portions 103*b*. The first cam body portion 103*a* and the second cam body portions 103*b* are interconnected through the protrusion shaft portions 103*c* so as to rotate as a unit.

Each of the second cam body portions 103*b* includes a first arc surface section 103*m* bulging radially outward when seen in the direction of a rotation axis of the second cam body portions 103*b*, and a second arc surface section 103*n* positioned at the 180° opposite side from the first arc surface section 103*m* across the rotation axis. The apex of the first arc surface section 103*m* constitutes a maximum radius section 103*p* where the distance from the rotation axis of the second cam body portions 103*b* becomes greatest. The apex of the second arc surface section 103*n* constitutes a minimum radius section 103*q* where the distance from the rotation axis of the second cam body portions 103*b* becomes smallest.

The maximum radius section 103P and the minimum radius section 103*q* of each of the second cam body portions 103*b* and the maximum radius section 103*j* and the minimum radius section 103*k* of the first cam body portion 103*a* are positioned on the same straight line extending through the rotation axis when seen in the direction of the rotation axis of the rotary cam member 103. The maximum radius section 103*p* of each of the second cam body portions 103*b* and the minimum radius section 103*k* of the first cam body portion 103*a* are positioned at the same side. The minimum radius section 103*q* of each of the second cam body portions 103*b* and the maximum radius section 103*j* of the first cam body portion 103*a* are positioned at the same side.

The shape of the mounting surface 101*c* of the tube support member 101 differs from that of the first embodiment. That is to say, the mounting surface 101*c* includes a semi-cylindrical surface portion 101*j* protruding toward the rotation axis of the rotary cam member 103. The semi-cylindrical surface portion 101*j* is positioned in the central region of the mounting surface 101*c* in the radial direction (the left-right direction in FIG. 9) when seen in the direction of the rotation axis of the rotary cam member 103. The curvature radius of the semi-cylindrical surface portion 101*j* is equal to or slightly smaller than the curvature radius of the external surface of the tube 70*a*.

Next, the operation of the flow path opening/closing device 100 according to the second embodiment will be described with reference to FIGS. 9 and 10.

FIG. 9 shows a state in which the opening/closing member 102 is in the opening position. In this state, the minimum radius section 103*k* of the first cam body portion 103*a* makes contact with the top end surface 102*f* of the opening/closing member 102. The maximum radius section 103P of each of the second cam body portions 103*b* makes contact with the semi-cylindrical surface portion 101*j* of the tube support member 101.

If the rotary cam member 103 is rotated clockwise from the state shown in FIG. 9, the opening/closing member 102 is pushed downward by the first cam body portion 103*a*. As shown in FIG. 10, when the maximum radius section 103*j* of the first cam body portion 103*a* makes contact with the top end surface 102*f* of the opening/closing member 102, the opening/closing member 102 comes closest to the tube support member 101. The position of the opening/closing member 102 available at this time is the closing position of the opening/closing member 102. In the meantime, if the rotary cam member 103 is rotated clockwise from the state shown in FIG. 9, the tube support member 101 is moved upward by the biasing force of the biasing spring 104. As shown in FIG. 10, when the minimum radius section 103*q* of each of the second cam body portions 103*b* makes contact with the semi-cylindrical surface portion 101*j* of the tube support member 101, the tube support member 101 comes closest to the opening/closing member 102.

As described above, according to the second embodiment, during the time when the opening/closing member 102 is driven from the opening position to the closing position, the tube support member 101 is moved from a farthest position where the tube support member 101 is spaced apart farthest from the opening/closing member 102 to a closest position where the tube support member 101 comes closest to the opening/closing member 102. Accordingly, the tube 70*a* can be crushed at the radial opposite sides thereof by the opening/closing member 102 and the tube support member 101. Thus, as compared with the first embodiment, it is possible to further reduce the force required in crushing the tube 70*a*.

In this regard, it is preferred that the moving distance of the opening/closing member 102 from the opening position to the closing position is equal to the moving distance of the tube support member 101 from the farthest position to the closest position. This makes it possible to keep constant the position of the center axis of the tube 70*a* when the tube 70*a* is crushed by the opening/closing member 102 and the tube support member 101. Accordingly, it is possible to prevent the center axis of the tube 70*a* from being bent as shown in FIG. 7. This makes it possible to significantly reduce the force required in crushing the tube 70*a*.

Third Embodiment

Figure 11A:
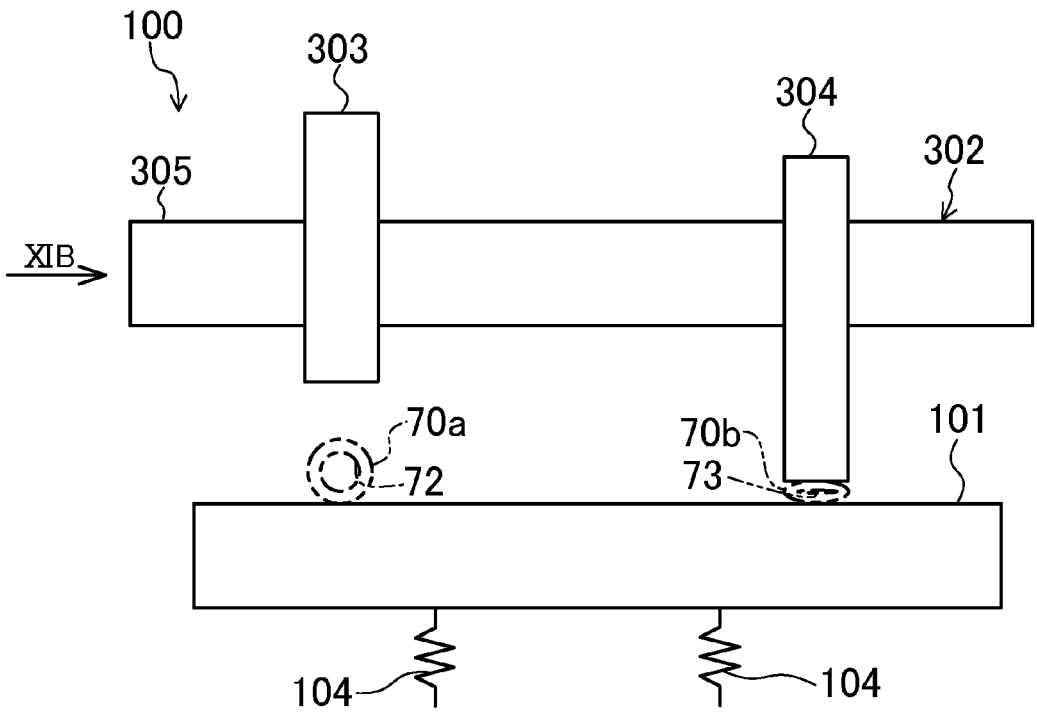
FIG. 11A is a side view of a flow path opening/closing device according to a third embodiment.
Figure 11B:
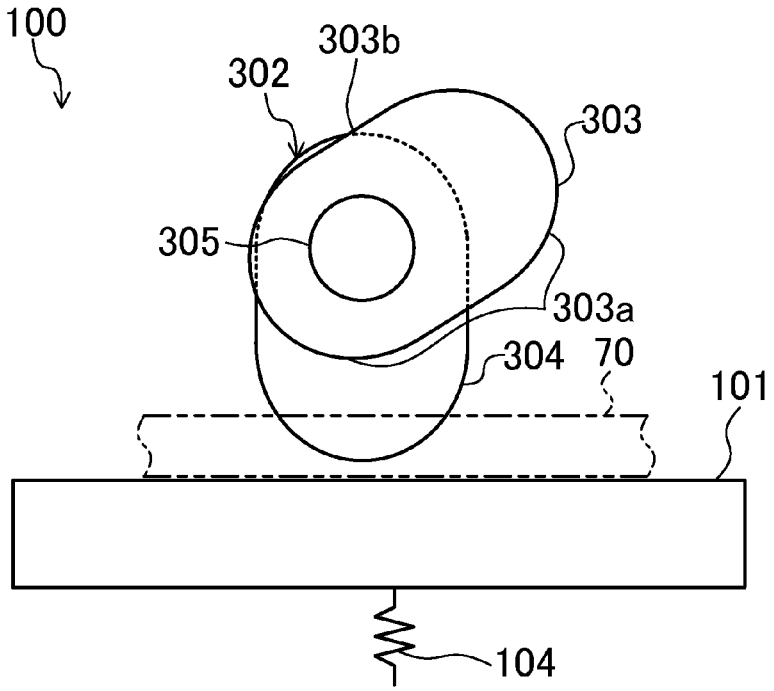
FIG. 11B is a view seen in a direction indicated by an arrow XIB in FIG. 11A.

FIGS. 11A and 11B show a flow path opening/closing device 100 according to a third embodiment. The flow path opening/closing device 100 includes a tube support member 101, a biasing spring 104 for supporting the tube support member 101 at the lower side thereof, and a rotary cam member 302 as an opening/closing member. An ink tube 70*a* that defines a second ink flow path 72 and an ink tube 70*b* that defines a third ink flow path 73 are mounted on the tube support member 101. The tube support member 101 is elastically supported by the biasing springs 104 so as to move toward and away from the rotary cam member 302.

The rotary cam member 302 includes a first opening/closing cam portion 303 for opening and closing the second ink flow path 72, a second opening/closing cam portion 304 for opening and closing the third ink flow path 73, and a connecting shaft portion 305 for interconnecting the opening/closing cam portions 303 and 304 so as to rotate as a unit. The opposite end portions of the connecting shaft portion 305 are rotatably supported by bearings (not shown) fixed to the housing of the inkjet printer A. Furthermore, the connecting shaft portion 305 is connected to a motor not shown. Responsive to a command transmitted from a controller, the motor rotates the connecting shaft portion 305 to a specified angular position corresponding to an operation of the inkjet printer A.

The first opening/closing cam portion 303 and the second opening/closing cam portion 304 have such a cam shape and an arrangement that, while the connecting shaft portion 305 makes one revolution, the first and second ink flow paths 72 and 73 should not be closed at the same time.

More specifically, in the present embodiment, the first opening/closing cam portion 303 has an oval plate-like shape as a whole. Particularly, the first opening/closing cam portion 303 includes a pair of semicircular plate portions 303*a* and a rectangular plate portion 303*b* that joins the semicircular plate portions 303*a*. The connecting shaft portion 305 is connected to the first opening/closing cam portion 303 in the width-direction central portion and in one longitudinal end portion of the first opening/closing cam portion 303. The other end portion of the first opening/closing cam portion 303 serves to cut off a flow path defined within the tube 70*a* by making contact with the external surface of the tube 70*a* as described later.

The second opening/closing cam portion 304 has the same shape as the first opening/closing cam portion 303 but differs from the first opening/closing cam portion 303 in terms of the arrangement angle about the axis of the connecting shaft portion 305. That is to say, as shown in FIG. 11B, the second opening/closing cam portion 304 is arranged in a position shifted 120° clockwise from the first opening/closing cam portion 303. The connecting shaft portion 305 is connected to the second opening/closing cam portion 304 in the width-direction central portion and in one longitudinal end portion of the second opening/closing cam portion 304. The other end portion of the second opening/closing cam portion 304 serves to cut off a flow path defined within the tube 70*b* by making contact with the external surface of the tube 70*b* as described later.

Figure 12:
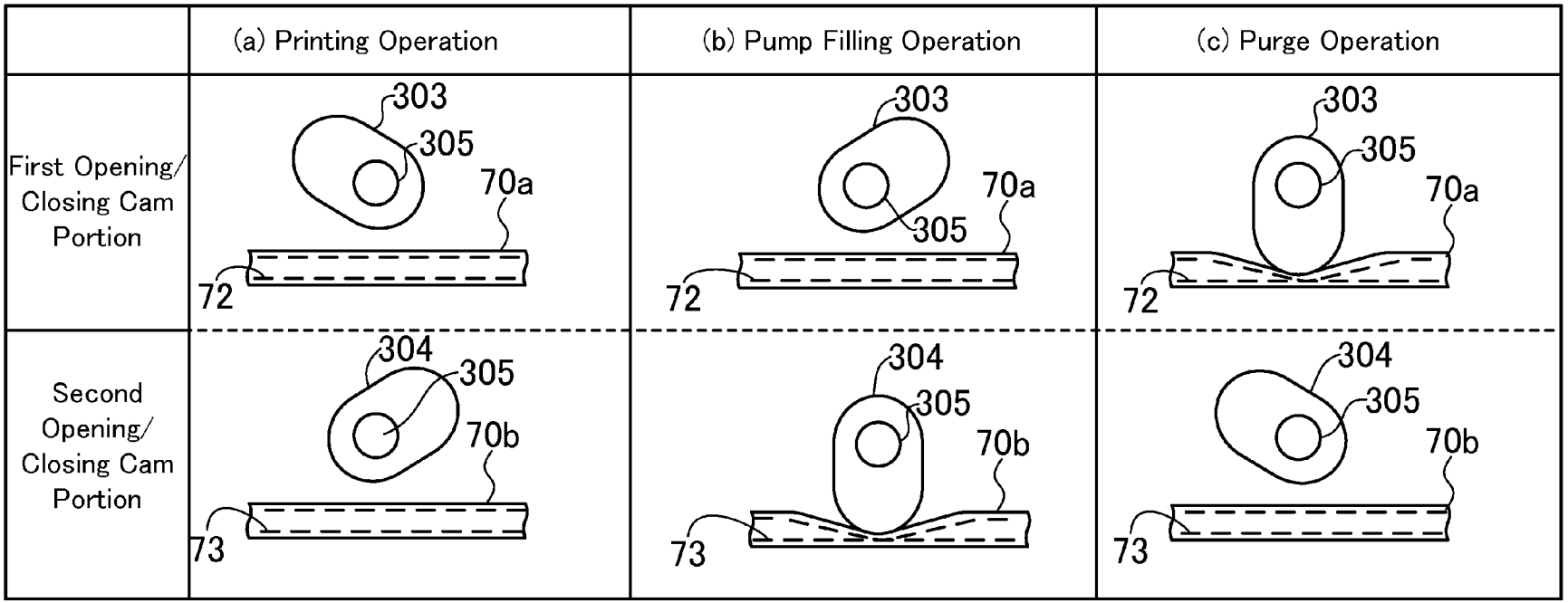
FIG. 12 is a schematic view showing the states of a first opening/closing cam portion and a second opening/closing cam portion, in which view (a) shows a printing operation, (b) shows a pump filling operation, and (c) shows a purge operation.

Next, description will be made on the operation of the flow path opening/closing device 100. As shown in FIG. 12(*a*), during a printing operation, the first opening/closing cam portion 303 and the second opening/closing cam portion 304 are spaced apart from the tube 70*a* and the tube 70*b*, respectively. For that reason, the second ink flow path 72 and the third ink flow path 73 come into an open state. During a pump filling operation, the connecting shaft portion 305 is rotated 120° clockwise from the state shown in FIG. 12(*a*). Then, as shown in FIG. 12(*b*), the other end portion of the second opening/closing cam portion 304 crushes the tube 70*b*, whereby the third ink flow path 73 comes into a closed state. In the meantime, the first opening/closing cam portion 303 is kept spaced apart from the tube 70*a*. Thus, the second ink flow path is kept in an open state. During a purge operation, the connecting shaft portion 305 is rotated 120° clockwise from the state shown in FIG. 12(*b*). Then, as shown in FIG. 12(*c*), the other end portion of the first opening/closing cam portion 303 crushes the tube 70*a*, whereby the second ink flow path 72 comes into a closed state. In the meantime, the other end portion of the second opening/closing cam portion 304 comes to be spaced apart from the tube 70*b*. Thus, the third ink flow path 73 comes into an opened state.

As described above, according to the third embodiment, when the second ink flow path 72 is closed by the first opening/closing cam portion 303, the third ink flow path 73 is opened by the second opening/closing cam portion 304. When the third ink flow path 73 is closed by the second opening/closing cam portion 304, the second ink flow path 72 is opened by the first opening/closing cam portion 303. Accordingly, there is no possibility that the second ink flow path 72 and the third ink flow path 73 are closed at the same time.

As set forth above, according to the third embodiment, the first opening/closing cam portion 303 and the second opening/closing cam portion 304 have such a cam shape and an arrangement that, while the connecting shaft portion 305 makes one revolution, the two ink flow paths 72 and 73 connected to the pump 80 should not be closed at the same time.

Accordingly, even if the piston 82 is unintentionally moved downward by, e.g., an erroneous operation of the piston drive unit 200, at least one of the second ink flow path 72 and the third ink flow path 73 is kept in an open state. Thus, there is no possibility that the piston 82 is damaged by a pressure rise within the ink accommodating chamber 83.

According to the third embodiment, the tube support member 101 is elastically supported by the biasing spring 104 so as to move toward and away from the rotary cam member 302. Accordingly, just like the first and second embodiments, it is possible to keep constant the pressing force applied to the tubes 70.

Fourth Embodiment

Figure 13:
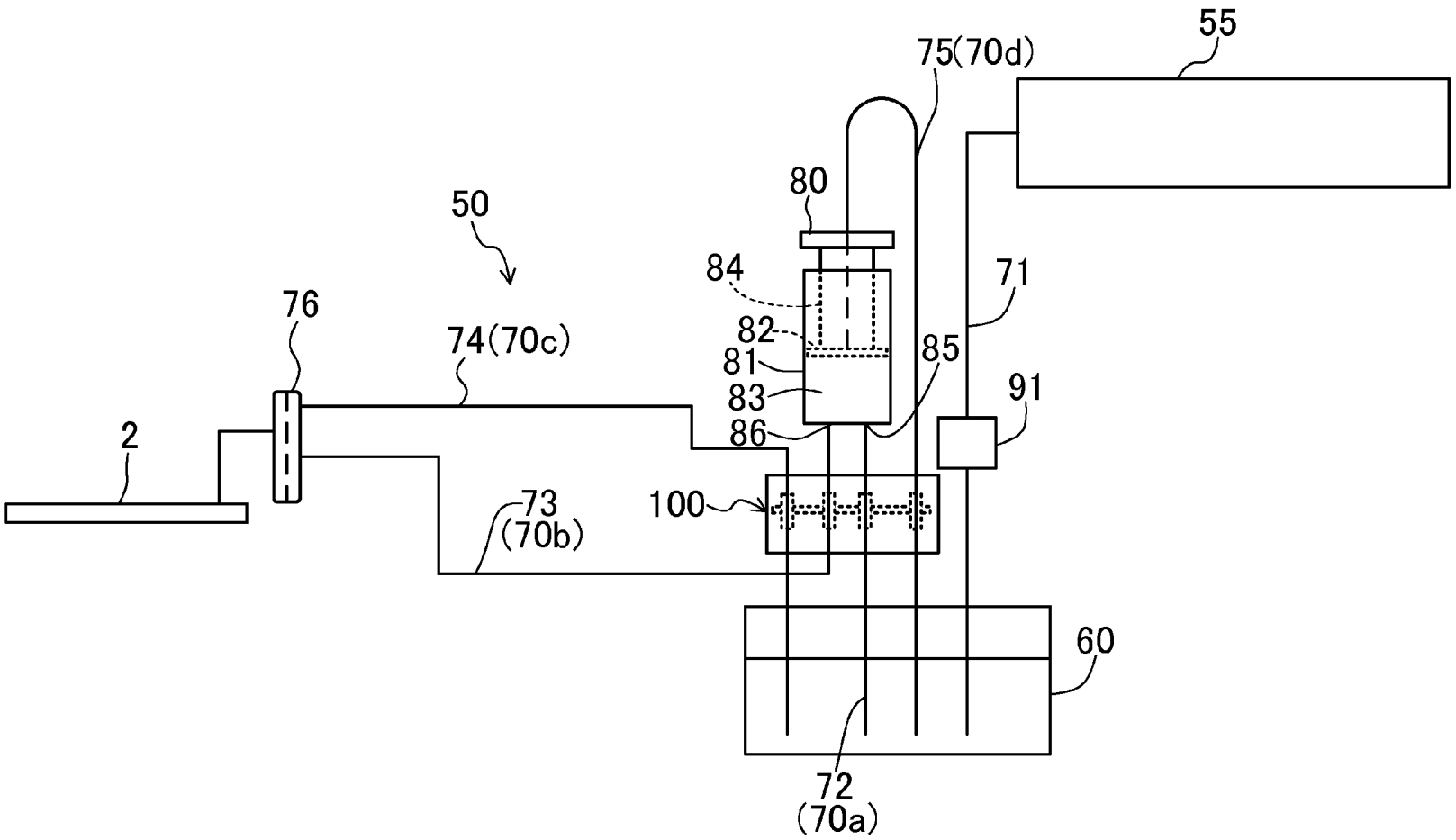
FIG. 13 is a view corresponding to FIG. 2, showing an ink supply mechanism according to a fourth embodiment.

FIG. 13 shows an ink supply mechanism 50 according to a fourth embodiment. The fourth embodiment differs from the third embodiment in terms of the flow path configuration of the ink supply mechanism 50 and the configuration of the flow path opening/closing device 100. In the following description, the same components as those shown in FIG. 2 will be designated by like reference symbols with detailed description thereof omitted.

Unlike the first embodiment, the ink supply mechanism 50 further includes a fourth ink flow path (corresponding to a fourth flow path) 74, a fifth ink flow path (corresponding to a third flow path) 75, and a filter 76.

The filter 76 is configured to remove foreign substances existing in the ink supplied to the inkjet head 2. The filter 76 is arranged in the third ink flow path 73 at the upstream side of the inkjet head 2. The fourth ink flow path 74 is connected at one end to the filter 76 and at the other end to the sub tank 60. The fifth ink flow path 75 extends through the piston rod 84 of the pump 8. One end of the fifth ink flow path 75 is connected to a through-hole (not shown) formed in the piston 82 so as to communicate with the ink accommodating chamber 83. The other end of the fifth ink flow path 75 is connected to the sub tank 60.

A flow path opening/closing device 100 is installed in the intermediate portions of the second to fifth ink flow paths 72 to 75. The flow path opening/closing device 100 is configured to open and close the ink flow paths 72 to 75.

FIG. 14 is a table summarizing the opening/closing states of the second to fifth ink flow paths 72 to 75 during a printing operation, a pump filling operation, a purge operation, a filter bubble removing operation, a pump bubble removing operation and a whole path opening operation. As shown in the table, during the printing operation, the second and third ink flow paths 72 and 73 are opened by the flow path opening/closing device 100 but the fourth and fifth ink flow paths 74 and 75 are closed by this device 100. Thus, the ink is supplied from the sub tank 60 to the inkjet head 2 via the second ink flow path 72, the pump 80 and the third ink flow path 73.

During the pump filling operation, the second and fifth ink flow paths 72 and 75 are opened by the flow path opening/closing device 100 and the third and fourth ink flow paths 73 and 74 are closed by this device 100. Furthermore, during the pump filling operation, the piston 82 is driven upward by the piston drive unit 200, whereby the ink is supplied from the sub tank 60 into the ink accommodating chamber 83 via the second and fifth ink flow paths 72 and 75.

During the purge operation, the second, fourth and fifth ink flow paths 72, 74 and 75 are closed by the flow path opening/closing device 100 and the third ink flow path 73 is opened by this device 100. Furthermore, during the purge operation, the piston 82 is driven downward by the piston drive unit 200, whereby the ink existing within the pump 80 is supplied to the inkjet head 2 via the third ink flow path 73 and is squeezed out from the nozzles of the inkjet head 2. Thus, the clogging of the nozzles is relieved.

During the filter bubble removing operation, the third and fourth ink flow paths 73 and 74 are opened by the flow path opening/closing device 100 and the second and fifth ink flow paths 72 and 75 are closed by this device 100. Furthermore, during the filter bubble removing operation, the piston 82 is driven downward by the piston drive unit 200, whereby the increase in the internal pressure of the ink accommodating chamber 83 is transmitted to the filter 76 via the third ink flow path 73. As a result, the bubbles existing within the filter 76 are discharged into the sub tank 60 through the fourth ink flow path 74.

During the pump bubble removing operation, the second, third and fourth ink flow paths 72, 73 and 74 are closed by the flow path opening/closing device 100 and the fifth ink flow path 75 is opened by this device 100. Furthermore, during the pump bubble removing operation, the piston 82 is driven downward by the piston drive unit 200, whereby the bubbles existing within the ink accommodating chamber 83 are discharged into the sub tank 60 through the fifth ink flow path 75.

During the whole path opening operation, the second to fifth ink flow paths 72 to 75 are all opened by the flow path opening/closing device 100.

—Flow Path Opening/Closing Device—

Figure 15A:
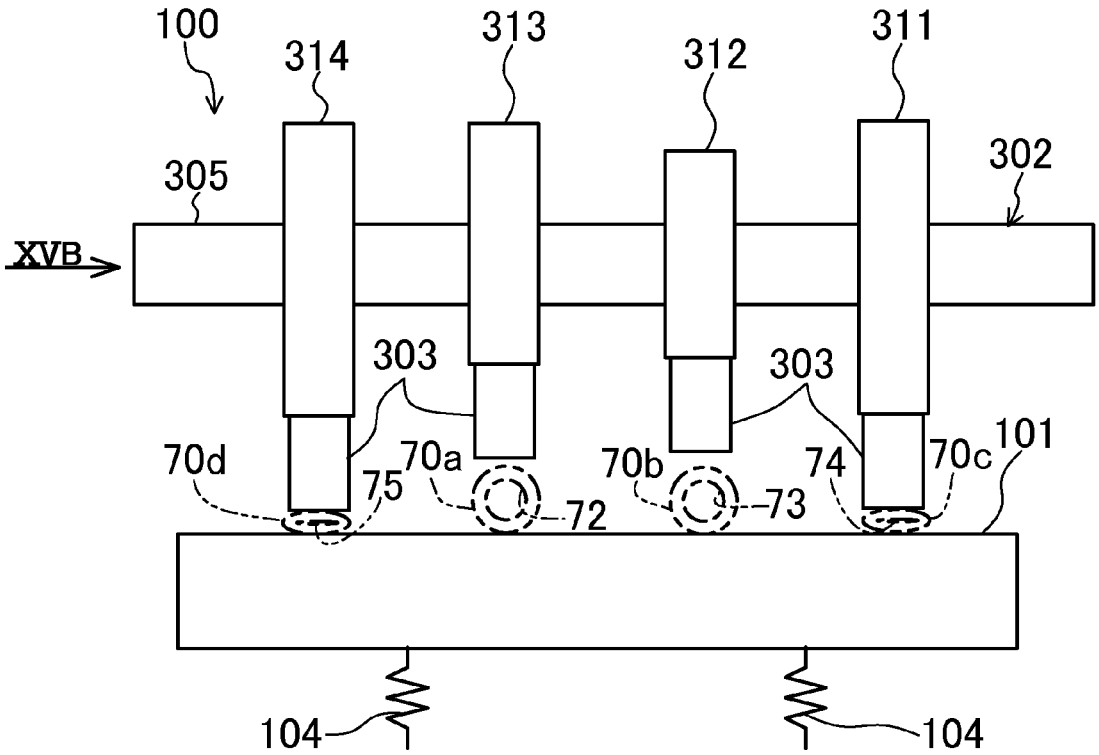
FIG. 15A is a side view of a flow path opening/closing device according to a fourth embodiment.
Figure 15B:
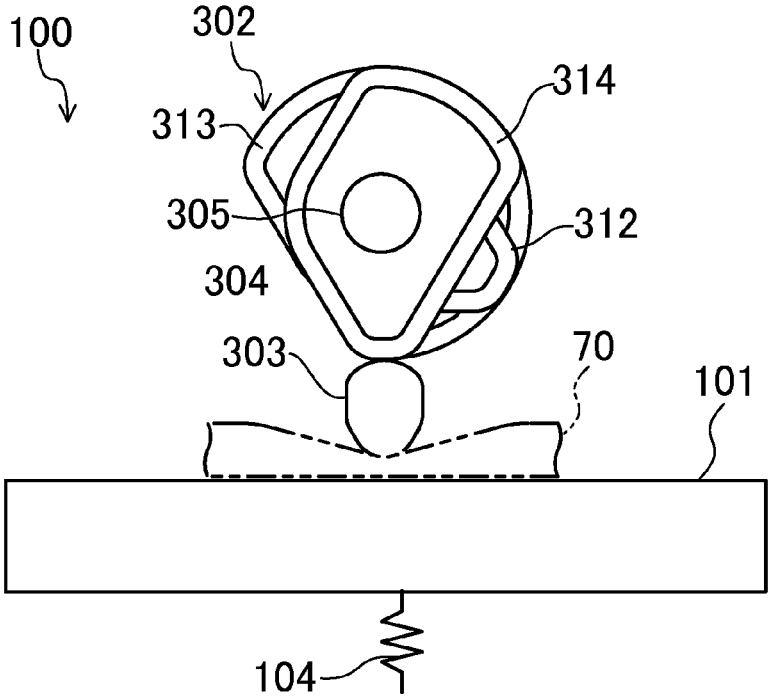
FIG. 15B is a view seen in a direction indicated by an arrow XVA in FIG. 15A.
Figure 16:
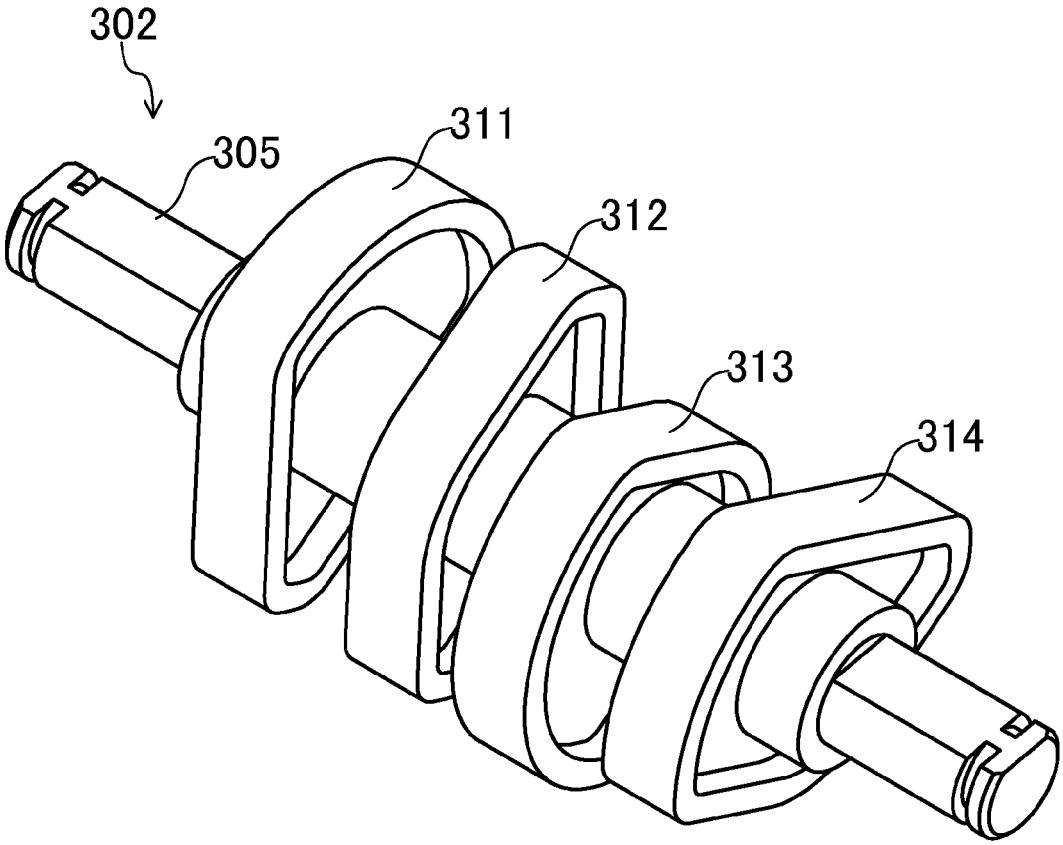
FIG. 16 is a perspective view showing a rotary cam member of the flow path opening/closing device according to the fourth embodiment.

As shown in FIGS. 15A, 15B and 16, the flow path opening/closing device 100 of the fourth embodiment differs from that of the first embodiment in terms of the configuration of the rotary cam member 302 as an opening/closing member. Furthermore, the flow path opening/closing device 100 of the fourth embodiment differs from that of the first embodiment in that the tubes 70 are not directly opened and closed by the rotary cam member 302 but are opened and closed by way of elevator bodies 303.

That is to say, ink tubes 70*a* to 70*d* that define second to fifth ink flow paths 72 to 75 are mounted on the tube support member 101. The rotary cam member 302 includes four opening/closing cam portions 311 to 314 for opening and closing the four ink flow paths 72 to 75. More specifically, the rotary cam member 302 includes a first opening/closing cam portion 311 for opening and closing the fourth ink flow path 74, a second opening/closing cam portion 312 for opening and closing the third ink flow path 73, a third opening/closing cam portion 313 for opening and closing the second ink flow path 72, and a fourth opening/closing cam portion 314 for opening and closing the fifth ink flow path 75. The respective opening/closing cam portions 311 to 314 are interconnected by a connecting shaft portion 305 so as to rotate as a unit.

Each of the opening/closing cam portions 311 to 314 is formed of a plate cam having a maximum radius section and a minimum radius section when seen in an axis direction of the connecting shaft portion 305. The outer circumferential surfaces of the respective opening/closing cam portions 311 to 314 serve as cam surfaces that make contact with the elevator bodies 303.

Four elevator bodies 303 in total are installed in a corresponding relationship with four opening/closing cam portions 311 to 314. Each of the elevator bodies 303 is composed of a substantially elliptical plate-like member elongated in the up-down direction. The respective elevator bodies 303 are biased upward by means of biasing springs (not shown) such that the top end portions of the elevator bodies 303 make contact with the outer circumferential surfaces of the opening/closing cam portions 311 to 314. The respective elevator bodies 303 reciprocate in the up-down direction as the opening/closing cam portions 311 to 314 rotate together with the connecting shaft portion 305. The respective elevator bodies 303 are configured such that the elevator bodies 303 crush the tubes 70 in the lowermost end positions within the movement ranges thereof, thereby closing the ink flow paths 72 to 75 defined within the tubes 70. The tubes 70 are returned to the original shape by a restoring force as the elevator bodies 303 move upward from the lowermost end positions. Thus, the ink flow paths 72 to 75 defined within the tubes 70 begin to be opened.

FIGS. 17 to 22 show the states of the respective opening/closing cam portions 311 to 314 during a printing operation, a pump filling operation, a purge operation, a filter bubble removing operation, a pump bubble removing operation and a whole path opening operation.

As shown in FIG. 17, during the printing operation, the fourth ink flow path 74 and the fifth ink flow path 75 are closed by the first opening/closing cam portion 311 and the fourth opening/closing cam portion 314, respectively. The second ink flow path 72 and the third ink flow path 73 are opened by the third opening/closing cam portion 313 and the second opening/closing cam portion 312, respectively.

During the pump filling operation, the connecting shaft portion 305 is rotated 60° clockwise from the state shown in FIG. 17. Then, as shown in FIG. 18, the fourth ink flow path and the third ink flow path 73 are closed by the first opening/closing cam portion 311 and the second opening/closing cam portion 312, respectively. The second ink flow path 72 and the fifth ink flow path 75 are opened by the third opening/closing cam portion 313 and the fourth opening/closing cam portion 314, respectively.

During the purge operation, the connecting shaft portion 305 is rotated 120° clockwise from the state shown in FIG. 17. Then, as shown in FIG. 19, the fourth ink flow path 74, the second ink flow path 72 and the fifth ink flow path 75 are closed by the first opening/closing cam portion 311, the third opening/closing cam portion 313 and the fourth opening/closing cam portion 314, respectively. The third ink flow path 73 is opened by the second opening/closing cam portion 312.

During the filter bubble removing operation, the connecting shaft portion 305 is rotated 180° clockwise from the state shown in FIG. 17. Then, as shown in FIG. 20, the second ink flow path 72 and the fifth ink flow path 75 are closed by the third opening/closing cam portion 313 and the fourth opening/closing cam portion 314, respectively. The fourth ink flow path 74 and the third ink flow path 73 are opened by the first opening/closing cam portion 311 and the second opening/closing cam portion 312, respectively.

During the pump bubble removing operation, the connecting shaft portion 305 is rotated 240° clockwise from the state shown in FIG. 17. Then, as shown in FIG. 21, the fourth ink flow path 74, the third ink flow path 73 and the second ink flow path 72 are closed by the first opening/closing cam portion 311, the second opening/closing cam portion 312 and the third opening/closing cam portion 313, respectively. The fifth ink flow path 75 is opened by the fourth opening/closing cam portion 314.

During the whole path opening operation, the connecting shaft portion 305 is rotated 300° clockwise from the state shown in FIG. 17. Then, as shown in FIG. 22, the fourth ink flow path 74, the third ink flow path 73, the second ink flow path 72 and the fifth ink flow path 75 are opened by the first opening/closing cam portion 311, the second opening/closing cam portion 312, the third opening/closing cam portion 313 and the fourth opening/closing cam portion 314, respectively. If the connecting shaft portion 305 is rotated 60° clockwise from the state shown in FIG. 22, the states of the respective opening/closing cam portions 311 to 314 are returned to the states available during the printing operation.

As described above, according to the fourth embodiment, the second to fourth opening/closing cam portions 312 to 314 are configured to make sure that the second, third and fifth ink flow paths 72, 73 and 75 are not closed at the same time during the printing operation (the origin position), the pump filling operation (the rotation angle of 60°), the purge operation (the rotation angle of 120°), the filter bubble removing operation (the rotation angle of 180°), the pump bubble removing operation (the rotation angle of 240°) or the whole path opening operation (the rotation angle of 300°).

Figure 23:
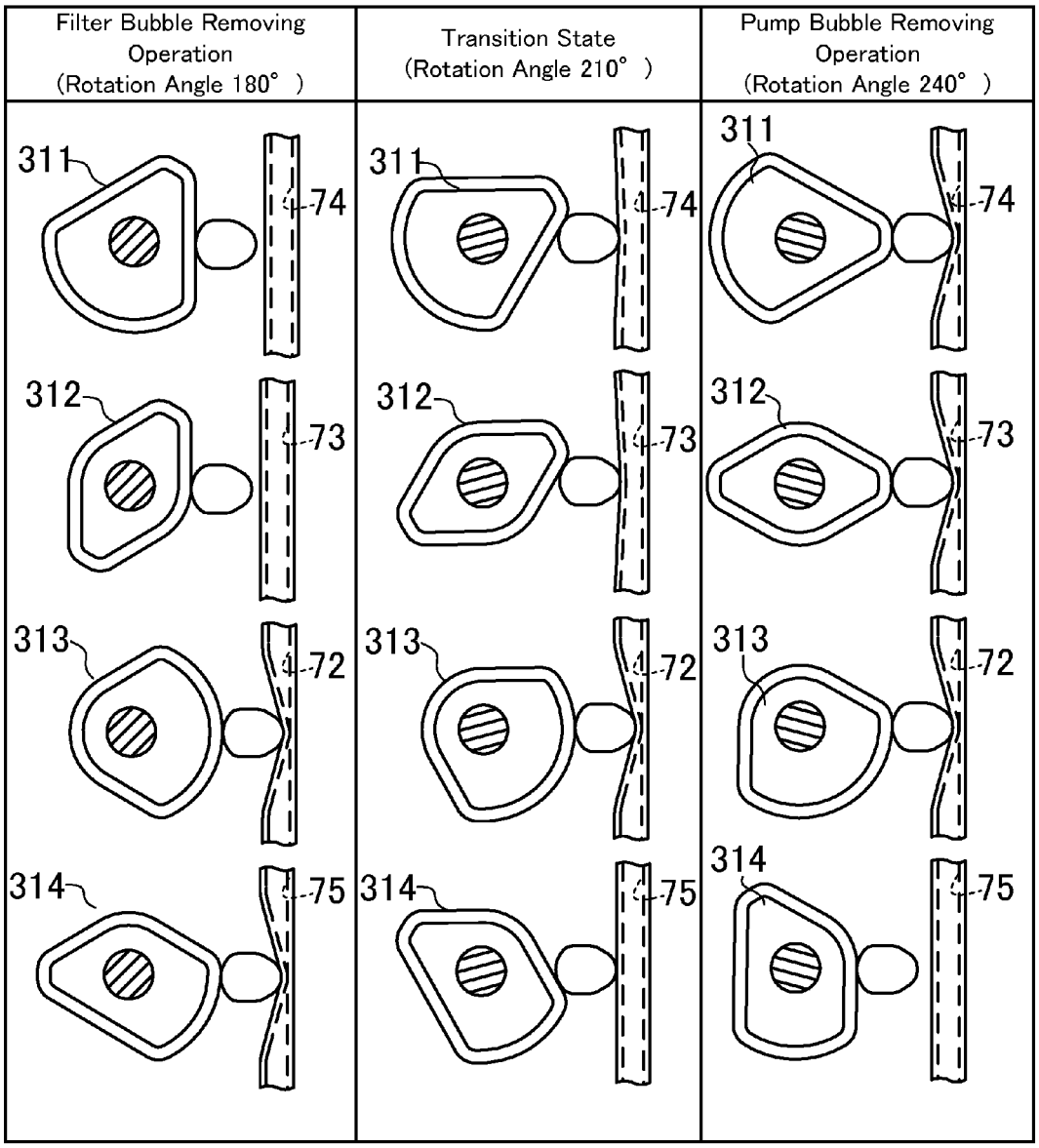
FIG. 23 is an explanatory view for explaining the states of individual opening/closing cam portions during transition from the filter bubble removing operation to the pump bubble removing operation.

FIGS. 17 to 22 don't show the transition states between the respective operations. The second to fourth opening/closing cam portions 312 to 314 are configured to make sure that the second, third and fifth ink flow paths 72, 73 and 75 are not closed at the same time even in these transition states. More specifically, the second to fourth opening/closing cam portions 312 to 314 are configured such that, when the open flow paths among the second, third and fifth ink flow paths 72, 73 and 75 connected to the pump 80 are switched to a closed state, the switching of the closed flow paths to an open state is started prior to the switching of the open flow paths to the closed state being finished. In the center column of FIG. 23, a transition state from the filter bubble removing operation to the pump bubble removing operation is shown as an example. According to FIG. 23, it can be noted that the fifth ink flow path 75 is switched from a closed state to an open state before the third ink flow path 73, among three ink flow paths 72, 73 and 75, which remains open during the filter bubble removing operation, is switched to a closed state.

As described above, according to the fourth embodiment, the respective opening/closing cam portions 312 to 314 have such a cam shape and an arrangement that, while the connecting shaft portion 305 makes one revolution, the three ink flow paths 72, 73 and 75 connected to the pump 80 should not be closed at the same time.

Accordingly, even if the piston 82 is unintentionally moved downward by, e.g., an erroneous operation of the piston drive unit 200, at least one of the second, third and fifth ink flow paths 72, 73 and 75 is kept in an open state. Thus, there is no possibility that the piston 82 is damaged by a pressure rise within the ink accommodating chamber 83.

Furthermore, according to the fourth embodiment, the tube support member 101 is elastically supported by the biasing spring 104 so as to move toward and away from the rotary cam member 302. Accordingly, just like the aforementioned embodiments, it is possible to keep constant the pressing force applied to the tubes 70.

According to the first and second embodiments described above, the opening/closing member 102 is designed to be linearly driven by the rotary cam member 103. However, the present disclosure is not limited thereto. A linear motion cylinder may be used in place of the rotary cam member 103.

According to the first and second embodiments described above, the tube 70*a* is pressed by the opening/closing member 102 installed between the rotary cam member 103 and the tube support member 101. However, the present disclosure is not limited thereto. For example, the tube 70*a* may be directly pressed by the rotary cam member 103. In this case, the rotary cam member 103 serves as a pressing member.

According to the embodiments described above, there is illustrated an example in which the recording liquid flowing through the tube 70*a* is the ink used in the inkjet printer A. However, the recording liquid is not limited to the ink but may be, e.g., a liquid toner used in liquid development.

According to the fourth embodiment described above, the tubes 70 are crushed by the respective opening/closing cam portions 311 to 314 through the elevator bodies 303. However, the present disclosure is not limited thereto. Just like the third embodiment, the elevator bodies 303 may be omitted and the tubes 70 may be directly crushed by the respective opening/closing cam portions 311 to 314.

According to the third and fourth embodiments described above, the pump 80 is a syringe pump. However, the present disclosure is not limited thereto. For example, the pump 80 may be a rotary pump such as a vane pump or a gear pump.

Figure 24:
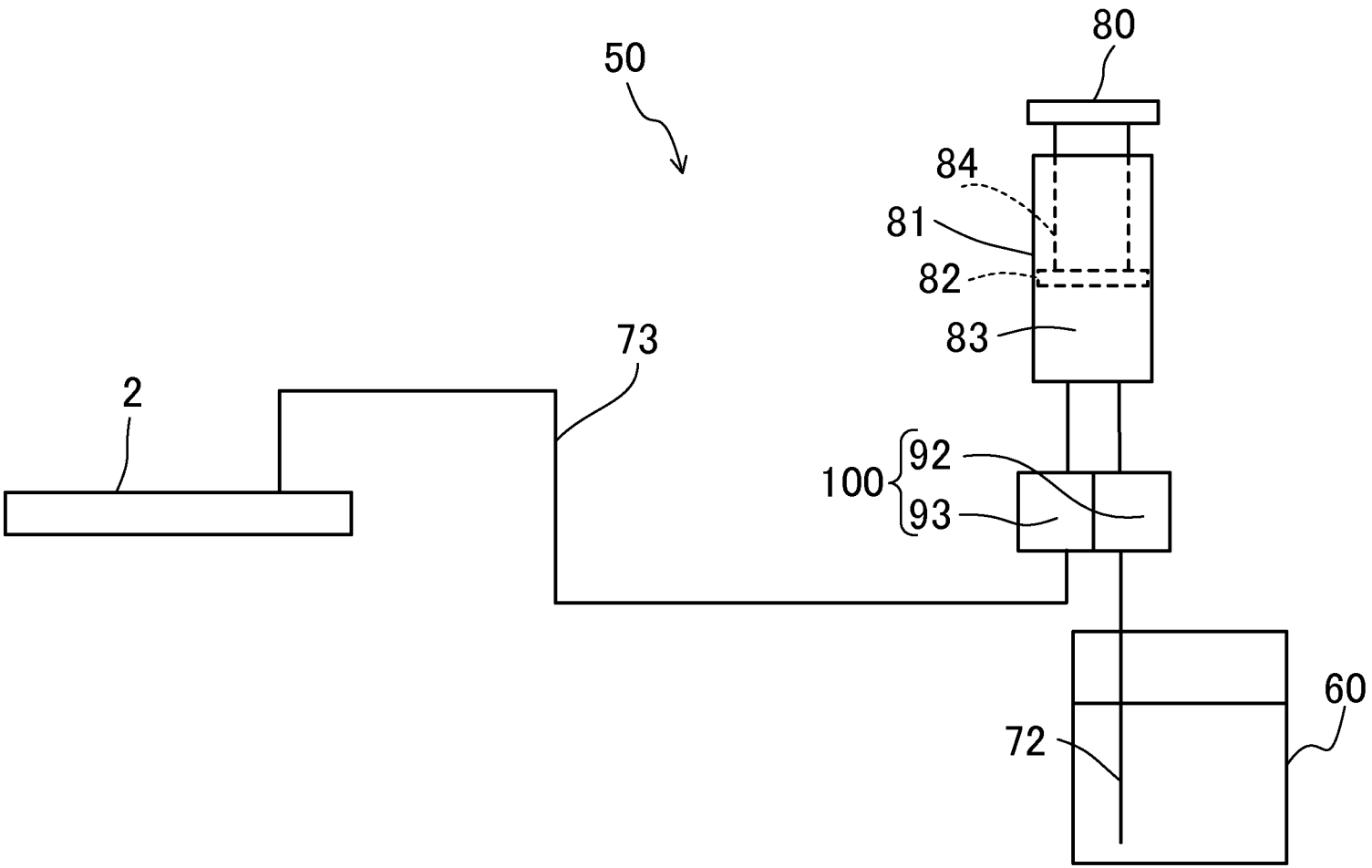
FIG. 24 is a view corresponding to FIG. 2, showing an ink supply mechanism according to other embodiment.

According to the third and fourth embodiments described above, there are installed two tanks, i.e., the sub tank and the main tank. However, the present disclosure is not limited thereto. For example, as shown in FIG. 24, only a tank 60 may be installed. In this case, the tank 60 may be arranged in a position lower than the inkjet head 2.

What is claimed is:

1. A flow path opening/closing device comprising:

a tube through which a recording liquid flows;

a tube support member on which the tube is mounted;

an opening/closing member configured to move between a closing position in which the opening/closing member crushes the tube mounted on the tube support member and cuts off a flow path defined within the tube and an opening position in which the cutoff of the flow path is cancelled by a restoring force of the tube; wherein the tube support member and the opening/closing member have the tube therebetween and are arranged to oppose to each other in a radial direction of the tube;

an elastic support member configured to elastically support the tube support member in the radial direction so as to move toward and away from the opening/closing member; and a drive unit configured to drive the opening/closing member, the drive unit including a rotary cam member, the opening/closing member being linearly driven by the rotary cam member so as to move toward and away from the tube support member.

2. The flow path opening/closing device of claim 1, wherein the tube support member includes a mounting surface on which the tube is mounted, the mounting surface having a curved surface shape so as to bulge toward the opening/closing member.

3. The flow path opening/closing device of claim 1, wherein the drive unit is configured to drive the tube support member in conjunction with the drive of the opening/closing member and is configured such that, when driving the opening/closing member from the opening position to the closing position, the drive unit moves the opening/closing member toward the tube support member and moves the tube support member toward the opening/closing member.

4. The flow path opening/closing device of claim 3, wherein the drive unit is configured such that, when driving the opening/closing member from the opening position to the closing position, the drive unit moves the opening/closing member toward the tube support member and moves the tube support member toward the opening/closing member while keeping constant a position of a center axis of the tube.

5. The flow path opening/closing device of claim 3, wherein the drive unit includes:

a first rotary cam portion having a maximum radius section and a minimum radius section; and a second rotary cam portion having a maximum radius section and a minimum radius section, the drive unit is configured such that the drive unit brings the minimum radius section of the first rotary cam portion into contact with the opening/closing member to thereby drive the opening/closing member toward the opening position and such that, in conjunction with the drive of the opening/closing member, the drive unit brings the maximum radius section of the second rotary cam portion into contact with the tube support member to thereby drive the tube support member toward a farthest position where the tube support member is spaced apart farthest from the opening/closing member, and the drive unit is configured such that the drive unit brings the maximum radius section of the first rotary cam portion into contact with the opening/closing member to thereby drive the opening/closing member to the closing position and such that, in conjunction with the drive of the opening/closing member, the drive unit brings the minimum radius section of the second rotary cam portion into contact with the tube support member to thereby drive the tube support member toward a closest position where the tube support member comes closest to the opening/closing member.

6. An inkjet recording apparatus comprising:

a tube through which a recording liquid flows;

a tube support member on which the tube is mounted;

an opening/closing member configured to move between a closing position in which the opening/closing member crushes the tube mounted on the tube support member and cuts off a flow path defined within the tube and an opening position in which the cutoff of the flow path is cancelled by a restoring force of the tube;

an elastic support member configured to elastically support the tube support member so as to move toward and away from the opening/closing member;

an ink tank configured to retain a recording liquid;

an inkjet head configured to record an image by ejecting the recording liquid on a recording paper;

a pump configured to supply the recording liquid retained in the ink tank to the inkjet head; and a plurality of flow paths connected to the pump, wherein the plurality of flow paths includes a first flow path configured to interconnect the ink tank and the pump and a second flow path configured to interconnect the pump and the inkjet head, the flow path opening/closing device includes a plurality of opening/closing cam portions installed in a corresponding relationship with the plurality of flow paths so as to open and close the plurality of flow paths and a connecting shaft portion configured to interconnect the opening/closing cam portions installed in a corresponding relationship with the plurality of flow paths such that the opening/closing cam portions rotate as a unit, and the opening/closing cam portions have such a cam shape and an arrangement that the plurality of flow paths is not closed at the same time.

7. The inkjet recording apparatus of claim 6, wherein the pump is a syringe pump that includes a cylinder, a piston accommodated within the cylinder so as to make reciprocating movement, and an ink accommodating chamber defined by the cylinder and the piston.

8. The inkjet recording apparatus of claim 7, wherein the first flow path and the second flow path are connected to the cylinder so as to communicate with the ink accommodating chamber of the pump, the plurality of flow paths further including a third flow path connected to the piston so as to communicate with the ink accommodating chamber of the pump.

9. The inkjet recording apparatus of claim 8, wherein the plurality of flow paths further includes a fourth flow path configured to interconnect the ink tank and the inkjet head, in addition to the opening/closing cam portions configured to open and close the plurality of flow paths connected to the pump, an opening/closing cam portion configured to open and close the fourth flow path is connected to the connecting shaft portion, and the opening/closing cam portions connected to the connecting shaft portion have such a cam shape and an arrangement that, during a filter bubble removing operation, the opening/closing cam portions configured to open and close the second flow path and the fourth flow path are in an opened state and the opening/closing cam portions configured to open and close the first flow path and the third flow path are in a closed state.

* * * * *